US007525515B2

(12) United States Patent
Choi

(10) Patent No.: US 7,525,515 B2
(45) **Date of Patent: *Apr. 28, 2009**

(54) PDP ENERGY RECOVERY APPARATUS AND METHOD AND HIGH SPEED ADDRESSING METHOD USING THE SAME

(75) Inventor: Jeong Pil Choi, Suwon (KR)

(73) Assignee: LG Electronics Inc., Seoul (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/979,214

(22) Filed: Oct. 31, 2007

(65) Prior Publication Data

US 2008/0117133 A1 May 22, 2008

Related U.S. Application Data

(63) Continuation of application No. 11/314,239, filed on Dec. 22, 2005, which is a continuation of application No. 09/790,620, filed on Feb. 23, 2001, now Pat. No. 7,053,869, said application No. 11/314,239 and a continuation of application No. 10/947,534, filed on Sep. 23, 2004, now Pat. No. 7,046,217, is a continuation-in-part of application No. 09/790,620, filed on Feb. 23, 2001, now Pat. No. 7,053,869.

(30) Foreign Application Priority Data

Feb. 24, 2000 (KR) ..... 2000-8944
Apr. 15, 2000 (KR) ..... 2000-19763
May 10, 2000 (KR) ..... 2000-25110

(51) Int. Cl.
*G09G 3/28* (2006.01)

(52) U.S. Cl. ..... 345/60; 345/66; 315/169.4

(58) Field of Classification Search ..... 345/60–63, 345/68, 74.1, 76; 313/484, 491, 514, 520; 315/169.4
See application file for complete search history.

(56) References Cited

U.S. PATENT DOCUMENTS

| | | | | |
|---|---|---|---|---|
| 4,707,692 | A | 11/1987 | Higgins et al. | |
| 4,772,884 | A | 9/1988 | Weber et al. | |
| 4,866,349 | A | 9/1989 | Weber et al. | |
| 5,081,400 | A | 1/1992 | Weber et al. | |
| 5,438,290 | A | 8/1995 | Tanaka | |
| 5,670,974 | A | 9/1997 | Ohba et al. | |
| 5,994,929 | A * | 11/1999 | Sano et al. | 327/111 |
| 6,011,355 | A | 1/2000 | Nagai | |
| 6,111,556 | A | 8/2000 | Moon | |
| 6,150,999 | A * | 11/2000 | Chen et al. | 345/60 |
| 6,175,192 | B1 | 1/2001 | Moon | |
| 7,053,869 | B2 * | 5/2006 | Choi | 345/60 |
| 2005/0012690 | A1 | 1/2005 | Choi | |

* cited by examiner

*Primary Examiner*—Richard Hjerpe
*Assistant Examiner*—Mansour M Said
(74) *Attorney, Agent, or Firm*—KED & Associates, LLP

(57) ABSTRACT

A PDP energy recovery apparatus and method controls the time point of charging and discharging energy to a plasma display panel (PDP) optimally and performs a high speed addressing. The PDP energy recovery apparatus includes a PDP, a driving integrated circuit unit for driving the PDP; and a PDP energy recovery circuit units for supplying energy to the PDP, charging an electric charge in the PDP at the time point when the electric charge discharged from the PDP is outputted the smallest, discharging the electric charge charged in the PDP, to thereby quicken the operating speed of the PDP.

23 Claims, 20 Drawing Sheets

PDP ENERGY RECOVERY APPARATUS AND METHOD AND HIGH SPEED ADDRESSING METHOD USING THE SAME

This application is a Continuation Application of U.S. application Ser. No. 11/314,239, filed Dec. 22, 2005, which is a Continuation Application of U.S. application Ser. No. 09/790,620, filed Feb. 23, 2001 (now U.S. Pat. No. 7,053,869). U.S. application Ser. No. 11/314,239, filed Dec. 22, 2005 is also a Continuation of U.S. application Ser. No. 10/947,534, filed Sep. 23, 2004 (now U.S. Pat. No. 7,046,217), which is a Continuation-In-Part of U.S. patent application Ser. No. 09/790,620, filed Feb. 23, 2001 (now U.S. Pat. No. 7,053,869). The subject matters of U.S. application Ser. Nos. 09/790,620, 10/947,534 and 11/314,239 are incorporated herein by reference.

BACKGROUND OF THE INVENTION

1. Field of the Invention

The present invention relates to a PDP (plasma display panel) energy recovery apparatus and method and a high speed addressing method using the same, and more particularly to a PDP energy recovery apparatus and method for controlling the time point of charging and discharging energy to the PDP optimally and a high speed addressing method using the same.

2. Description of the Background Art

In the PDP, when a ultraviolet ray generated in plasma discharging due to He—Ne gas or Ne—Xe gas excites a red, a green and a blue fluorescent material formed at barrier ribs in discharge cells separated by cross barrier ribs, a character or a graphic is displayed by a visible ray on the basis of the principle that a visible ray is generated and discharged when the excited fluorescent material is transited in a base state. The discharge cells are arranged in a matrix and the one cell becomes a pixel on a screen.

The PDP having the above-described structure does not need an electric gun like a cathode ray tube, so that it can implement a thin, light and large screen with high definition.

As the PDP has an electrode, a dielectric layer and a discharge gas and is operated by charging and discharging, it is functioned like a capacitor for charging electric charge. Thus, the PDP consumes much energy in charging and discharging, and the larger its size is, the more energy is consumed.

Therefore, when the PDP is operated, in order to effectively consume the energy, an energy recovery apparatus is used to recover the energy which has been supplied to the PDP and to supply the recovered energy back to the PDP. The PDP energy recovery apparatus has been used to be connected with a sustain electrode by using a sustain waveform inputted to the sustain electrode, and recently, it is used to be also connected with a data electrode.

FIG. 1 is a perspective view showing a face-discharge type PDP structure in accordance with a conventional art.

As shown in the drawing, the conventional face-discharge type PDP includes an upper substrate 10, an scan/sustain electrode 12Y and a common/sustain electrode 12Z formed at the upper substrate 10, an upper dielectric layer 14 for accumulating a wall charge generated when plasma is discharged, a protective film 16 for preventing the upper dielectric layer 14 from damaging by sputtering generated when the plasma is discharged as well as heightening discharges of secondary electrons, a lower substrate 18, an address electrode 20X formed at the lower substrate 18, a lower dielectric layer 22 for accumulating a charge of the address electrode 20X, barrier ribs 24 formed at the lower dielectric layer 22 and a fluorescent material 26 coated on the barrier ribs 24 and at the lower dielectric layer 22.

The address electrode 20X is formed in a cross direction to the scan/sustain electrode 12Y and the common/sustain electrode 12Z, and the barrier rib 24 is formed in parallel with the address electrode 20X, so that the ultraviolet ray and the visible ray generated by discharging is not leaked to the adjacent discharge cell.

The fluorescent material 26 generates one of the red, the green and the blue visible rays excited by the ultraviolet rays generated when the plasma is discharged. An inert gas, such as He—Ne or Ne—Xe, is injected in the barrier ribs 24 formed between the upper substrate 10 and the lower substrate 18, for gas discharging.

Also, the protective film 16 is made of a material such as magnesium oxide (MgO).

FIG. 2 illustrates a construction of a drive unit of a AC face discharge type PDP in accordance with the conventional art, which includes a PDP 30 at which the scan/sustain electrode lines (Y1, Y2, . . . , Ym), the common/sustain electrode lines Z1, Z2, . . . , Zm) and address electrodes (X1, X2, . . . , Xn) are connected to form the discharge cells 1 arranged in a m×n matrix form, a scan/sustain driving unit 32 for driving the scan/sustain electrode lines, a common/sustain driving unit 34 for driving the common/sustain electrode lines, a first address electrode line driving unit 36A for driving the address electrode lines at odd numbers (X1, X3, . . . , Xn−1), and a second address electrode line driving unit 36B for driving and address electrode lines at even numbers (X2, X4, . . . , Xn). The scan/sustain driving unit 32 sequentially provides a scan pulse and a sustain pulse to the scan/sustain electrode lines to sequentially scan the discharge cells by lines and sustains discharging of m×n number of discharge cells.

The common/sustain driving unit 34 provides the sustain pulse to every common/sustain electrode lines, and the first and the second address driving units 36A and 36B provide an image data to the address electrode lines so as to be synchronized with the scan pulse. Subsequently, the first address driving unit 36A provides the image data to the odd number address electrodes X1, X3, . . . , Xn−1, while the second address driving unit 36B provides the image data to the even number address electrode lines X2, X4, . . . , Xn.

In order to discharge the AC face discharge type PDP by the address electrode and the sustain electrode, a voltage higher than hundreds of voltage must be supplied to the electrodes.

An energy recovery apparatus is installed at the scan/sustain driving unit, the common/sustain driving unit and the address driving unit to supply required energy to the address discharge and the sustain discharge according to the next data signal and minimize the energy to be supplied back to the address electrode and the sustain electrode according to the next data. That is, the energy recovery apparatus recovers the voltage charged at the scan/sustain electrode line (Y) and the common/sustain electrode line (Z) and the energy charged between the address electrode lines (X) and reuse the recovered energy as a driving voltage when the PDP is discharged again.

FIG. 3 is a circuit diagram of a PDP energy recovery apparatus in accordance with a first embodiment of the conventional art.

The PDP energy recovery apparatus includes a panel capacitor Cp installed connected with the scan/sustain driving unit 32, which is an equivalent circuit element to the PDP, and a PDP energy recovery circuit unit 38 for recovering energy of the panel capacitor Cp.

The PDP energy recovery circuit unit 38 includes an energy recovery capacitor Cr for charging and discharging the energy from and to the panel capacitor Cp, a coil L connected between the energy recovery capacitor Cr and the panel capacitor Cp so as to be make a resonance with the panel capacitor Cp, a first and a third switches S1 and S3 for switching the charge and discharge of the energy recovery capacitor Cr, a second switch S2 for switching supply of the power source (i.e., the sustain voltage) to the panel capacitor Cp, and a fourth switch S4 for grounding the panel capacitor Cp to lower a voltage level to the ground voltage when the panel capacitor Cp is discharged.

When the panel capacitor Cp discharges the sustain voltage Vsus, the voltage charged in the panel capacitor Cp is recovered and charged in the energy recovery capacitor Cr, and the charged voltage is discharged again to the panel capacitor Cp. In addition, the voltage (Vsus/2) corresponding to half of the sustain voltage of the panel capacitor Cp is charged in the energy recovery capacitor Cr.

The coil L forms a resonance circuit together with the panel capacitor Cp according to an operation of the first through the fourth switches.

The PDP energy recovery circuit unit 38 connected with the scan/sustain driving unit 32 may be also installed at the common/sustain driving unit 34.

The operation of the PDP energy recovery apparatus in accordance with the first embodiment of the present invention will now be described.

FIG. 4A is a waveform of an operation of the PDP energy recovery apparatus in accordance with the first embodiment of the conventional art.

Let's assume that, before a 'T1' interval, a voltage charged between the scan/sustain electrode line 'Y' and the common/sustain electrode line 'Z', that is, the voltage (VCp) charged in the panel capacitor Cp is '0' and the half (Vsus/2) of the sustain voltage is to be charged in the energy recovery capacitor Cr.

At T1 interval, when the first switch S1 is turned on, a current path is formed from the energy recovery capacitor Cr through the first switch S1, the coil L to the panel capacitor Cp, so that the voltage Vsus/2 charged in the energy recovery capacitor Cr flows to the panel capacitor Cp.

At this time, since the coil L and the panel capacitor Cp forms a serial resonance circuit, as the voltage Vsus/2 charged in the energy recovery capacitor Cr passes the coil L of the serial resonance circuit.

At a T2 interval, since the first switch S1 is turned off in a state that the second switch S2 is turned on, the sustain voltage is supplied to the scan/sustain electrode line 'Y', so that the voltage of the panel capacitor sustains the sustain voltage Vsus.

At a T3 interval, when the second switch S2 is turned off and the third switch S3 is turned on, the sustain voltage Vsus charged in the panel capacitor Cp is discharged to the energy recovery capacitor Cr through the coil L and the third switch S3. As the panel capacitor Cp is discharged, the sustain voltage Vsus charged in the panel capacitor drops, and at the same time, the voltage of Vsus/2 is charged in the energy recovery capacitor Cr.

At a T4 interval, when the third switch S3 is turned off and the fourth switch S4 is turned on, since the voltage level of the panel capacitor Cp is grounded (GND), the voltage VCp of the panel capacitor Cp becomes '0'.

At a T5 interval, the state of the T4 interval is maintained for a certain time.

Accordingly, as the AC pulse is supplied to the scan/sustain electrode line 'Y' and the common/sustain electrode line 'Z' during the T1~T5 intervals, the voltage VCP is repeatedly charged in and discharged from the panel capacitor Cp.

In this respect, the current iL flows to the coil as a resonance current when the panel capacitor Cp is charged and discharged.

FIG. 5A is a PDP energy recovery apparatus in accordance with a second embodiment of the conventional art.

As shown in the drawing, the PDP energy recovery apparatus includes a panel capacitor Cp as an equivalent circuit element to the PDP, an address driving unit 36A for controlling driving of the PDP, and a PDP energy recovery circuit unit 40 for recovering the energy of the panel capacitor Cp.

The address driving unit 36A implemented as an integrated circuit includes a logic processor 36A-1 for processing a small signal, FETs Q1 and Q2 for receiving the output signals of the logic processor 36A-1 to their gates and switching data signals according to the output signal, and a high voltage processor 36A-2 having parasitic diodes D1 and D2 respectively connected to the FETs Q1 and Q2.

The PDP energy recovery circuit unit 40 includes an energy recovery capacitor Cr for charging and discharging energy from and to the panel capacitor Cp, a coil L connected between the energy recovery capacitor Cr and the panel capacitor Cp to make a resonance with the panel capacitor Cp, a first and a third switches S1 and S3 for switching charge and discharge of the energy recovery capacitor Cr, a second switch S2 for switching supply of a power Vd to the panel capacitor Cp, and a fourth switch S4 for grounding the panel capacitor Cp to lower down a voltage level of the panel capacitor Cp to a ground voltage when the panel capacitor Cp is discharged.

The operation of the PDP energy recovery apparatus of the second embodiment of the present invention constructed as described will now be explained.

When the energy recovery apparatus is operated and the PDP is successively charged and discharged, the second switch S2 and the fourth switch S4 are switched in balance to supply and recover the energy, so that the energy recovery capacitor Cr included in the PDP energy recovery unit 40 is charged with the half voltage Vsus/2 of the voltage charged in the PDP. That is, when the third switch S3 is turned on, the half voltage Vsus/2 of the voltage which has been supplied to the data electrode is charged in the energy recovery capacitor Cr, and then, the fourth switch S4 is turned on to ground the voltage level of the panel capacitor Cp.

Only when a data is supplied, the driver IC 36A receives the Vsus/2 voltage from the PDP energy recovery circuit unit 40 and supplies it to the panel capacitor Cp. And then, the driver IC 36A switches on or off according to a scanning time so that the voltage charged in the panel capacitor Cp is charged in the energy recovery capacitor Cr.

At a T1 interval, when the first FET Q1 receives a high level signal from the logic processing unit 36A-1 and is turned on, it receives the Vsus voltage from the PDP energy recovery circuit unit 40, and at T2 interval, the 1 FET Q1 keeps turning on till the section where the high level data is maintained, so that the voltage is supplied from the energy recovery unit 40 thereto.

At a T3 interval, when the data is changed from a high level to a low level, the energy supplied to the data electrode is recovered from the PDP energy recovery circuit 40 through the first FET Q1 and the parasitic diode D1.

The T1 interval is an energy recovery ascending interval, that is, energy up(Er_up) corresponding to the state that the first switch S1 of the PDP energy recovery circuit unit 40 is turned on, and the T2 interval is an energy up sustaining interval (Sus_up) corresponding the state that the second switch S2 is turned on.

The T3 and T4 intervals are an energy recovery down intervals corresponding to the states that the third switch S3 is turned on, and the T5 interval is an energy down sustaining interval (Sus_down) corresponding to the state that the fourth switch S4 is turned on.

In the output wave form of the panel capacitor Cp, the T2 interval is an interval to transmit the data voltage, and the other intervals are operation intervals for supplying and recovering energy to effectively supply the data voltage.

Accordingly, in order to address the data at a high speed, the time for the intervals except for the T2 interval should be short.

FIG. 5B is an equivalent circuit diagram of the PDP energy recovery apparatus, which includes a fifth switch S5 and a sixth switch S6 equivalent to the logic processing unit 36A-1, the FETs and the parasitic diodes D1 and D2, included in the address driving unit 36A of FIG. 5A.

Meanwhile, like the first address driving unit 36A, the second address driving unit 36B may be installed to be connected with the PDP energy recovery circuit unit 40, based on which the operation of the PDP energy recovery apparatus in accordance with the second embodiment of the conventional will now be described.

FIG. 6 illustrates operational wave forms of the PDP energy recovery apparatus of FIG. 5A or FIG. 5B in accordance with the second embodiment of the conventional art.

Let's assume that, before the T1 interval, a voltage charged between the address electrode lines (X), that is, the voltage charged in the panel capacitor Cp, is '0' and Vd/2 voltage is charged in the energy recovery capacitor Cr.

At a T1 interval, if the first and the fifth switches S1 and S5 are turned on (At this time, if the discharge cell of the PDP is not selected, that is, no data pulse is supplied to the address electrode line 'X', the fifth switch S5 is maintained to be turned off), a current path is formed from the energy recovery capacitor Cr to the first switch S1, the coil L and to the panel capacitor Cp.

Since the coil L and the panel capacitor Cp form a serial resonance circuit, the voltage VCp of the panel capacitor Cp goes up to Vd which is twice of the voltage Vd/2 of the energy recovery capacitor.

At a T2 interval, since the first switch S1 is turned off in the state that the second switch S2 is turned on, the address voltage Vd is supplied to the address electrode line 'X', so that the voltage VCp of the panel capacitor Cp sustains the address voltage Vd.

At a T3 interval, when the second switch S2 is turned off and the third switch S3 is turned on, the address voltage Vd charged in the panel capacitor Cp is discharged through the coil L and the third switch S3 to the energy recovery capacitor.

When the panel capacitor Cp is discharged, the address voltage Vd charged in the panel capacitor Cp goes down, and at the same time, the voltage Vd/2 is charged in the energy recovery capacitor Cr.

At a T4 interval, when the third switch S3 is turned off and the fourth and the fifth switches S4 and S5 are turned on, the voltage level of the panel capacitor Cp is grounded (GND) and the voltage VCp of the panel capacitor Cp becomes '0'.

At a T5 interval, the voltage state of the T4 is maintained for a predetermined time.

Accordingly, the AC pulse is supplied to the address electrode line 'X' at the T1~T5 intervals, so that the voltage VCP is repeatedly charged in and discharged from the panel capacitor Cp.

The current iL flows to the coil as a resonance current when the panel capacitor Cp is charged and discharged.

The output wave form of the panel capacitor Cp will now be described in detail.

FIGS. 7A through 7D are wave forms of the T1~T5 intervals of FIG. 6.

At the T1 interval, as shown in FIG. 7A, when the first and the fifth switches S1 and S5 are turned on, a resonance circuit is formed by the coil L and the panel capacitor Cp, generating a resonance wave form.

At this time, the panel capacitor Cp is charged at the first resonance point 42 of a resonance wave form. When the second switch S2 is turned on, an output wave form of the panel capacitor is generated next the first resonance point 42 as shown in FIG. 7B.

At the T3 and T4 intervals, as shown in FIG. 7C, when the third switch S3 is turned on, a resonance circuit is formed by the coil L and the energy recovery capacitor Cr, generating a resonance wave form. At this time, the energy recovery capacitor Cr is charged when the resonance wave form goes down to the second resonance point 44.

After the resonance wave form goes down to the second resonance point 44, when the fourth switch S4 is turned on, as shown in FIG. 7D, an output wave form of the panel capacitor Cp is generated.

Accordingly, a data pulse is generated through the processes of FIGS. 7A~7D.

FIG. 8 illustrate a wave form showing a data pulse of the PDP energy recovery apparatus in accordance with the conventional art.

The data pulse outputted according to the operation of the PEP energy recovery apparatus of the conventional art is divided into a P1 interval (corresponding to the T1 interval of FIGS. 4 and 6) where a voltage is charged in the panel capacitor Cp, a P2 interval (corresponding to the T2 interval of FIGS. 4 and 6) where the data pulse is supplied to the address electrode line, a P3 interval (corresponding to the T3 and T4 intervals of FIGS. 4 and 6) where the voltage charged in the panel capacitor is recovered to be charged in a source capacitor, and a P4 interval (corresponding to T5 interval of FIGS. 4 and 6) where the voltage of the panel capacitor Cp goes down to '0'.

The P2 interval is substantially required for address discharge, while the P1, P3 and P4 intervals are preliminary intervals at which the voltage is charged in the energy recovery capacitor Cr and the panel capacitor Cp.

In this respect, the higher the addressing speed, the more increasing the ground level duration. That is, the P2 interval, which is substantially required for the address discharge, is reduced, whereas the intervals P1, P3 and P4 for charging the voltage to the energy recovery capacitor Cr and the panel capacitor Cp are not reduced.

Therefore, the preliminary intervals at which the voltage is charged in the energy recovery capacitor and the panel capacitor are not controllable, it is difficult to perform addressing at a high speed.

The conventional art is disadvantageous for the following reason. For example, when the AC face discharging PDP of the conventional art operates, an address interval (or an address discharge pulse width) should be more than 2.5 μs. In this respect, however, in a state that an interval of one frame is fixed by 16.7 ms, if the address discharge pulse width is lengthened to more than 2.5 μs, the rate that the sustain interval which substantially controls the brightness of a screen drops to below 30%.

In addition, in order to reduce the contour noise generated at the mobile image, sub-fields in one frame interval increase from 8 to 10~12 in number.

Moreover, if the number of sub-fields is increased in the fixed one frame interval, each sub-field interval is accordingly shortened, and in this case, the address interval is fixed by sub-fields while only the sustain interval is shortened for a stable discharge.

Furthermore, if the scan/sustain electrode lines increase in number, the sustain interval at the high resolution PDP is too shortened, failing to display an image through the PDP.

Thus, in the high resolution PDP, the address interval that the scan/sustain electrode lines are sequentially driven is lengthened. Then, the sustain interval is shortened at the fixed one frame interval.

In addition, the energy recovery circuit of the conventional art is also disadvantageous in that in case that there is much change in the data supplied to the address electrode lines, the energy consumption can be reduced. But, in case of a full white data and a blank data with no data change, the energy is rather consumed due to the unnecessary switching operation in the energy recovery circuit. That is, in case of the full white data, the address data must be supplied to every address electrode line.

In the case that the address data is supplied to every address electrode line, the address driving unit should outputs a data pulse continuously.

However, even in this case, the energy recovery circuit should perform the unnecessary switching operation, much energy is consumed. Accordingly, in the conventional energy recovery apparatus, the energy recovery circuit is not operated in case of the full white data and the blank data upon checking the data. In this respect, however, since the PDP energy recovery circuit should be turned on and off only in case of the full white data and the blank data among the diversely changed data, the energy is unnecessarily consumed.

Moreover, in the conventional PDP every recovery apparatus, the energy recovery circuit used for data processing includes many switching units, and since the energy down sustain (Sus_down) operation, that is, a process for lowing down the level to a base voltage, is necessarily performed, the energy recovery apparatus has a large size and is not capable to addressing a data at a high speed.

SUMMARY OF THE INVENTION

Therefore, an object of the present invention is to provide a PDP energy recovery apparatus that is capable of controlling optimally the time point of energy charged into and discharged from a PDP, and its method.

Another object of the present invention is to provide a PDP energy recovery apparatus that is capable of controlling optimally the time point of energy charged into and discharged from a PDP and of addressing at a high speed, and its method.

Still another object of the present invention is to provide a PDP energy recovery apparatus that is capable of addressing at a high speed and of reducing an energy consumption, and its method.

Yet another object of the present invention is to provide a PDP energy recovery method that is capable of controlling optimally the time point of energy charged into and discharged from a PDP and of addressing at a high speed.

To achieve these and other advantages and in accordance with the purpose of the present invention, as embodied and broadly described herein, there is provided a PDP energy recovery apparatus including: a plasma display panel (PDP) Cp; a driving integrated circuit unit 36A for driving the PDP; and a PDP energy recovery circuit units for supplying energy to the PDP, charging an electric charge in the PDP at the time point when the electric charge discharged from the PDP is outputted the smallest, discharging the electric charge charged in the PDP, to thereby quicken the operating speed of the PDP.

To achieve the above objects, there is also provided a PDP energy recovery method including the steps of: forming a first resonance circuit so that a half voltage of a driving voltage of the PDP charged in a capacitor can flow to the PDP; discharging the capacitor from the time point when a resonance wave form is formed by the first resonance circuit to a first lowermost resonance point; forming a second resonance circuit for charging the electric charge discharged from the PDP; and charging the capacitor from the time point when a resonance wave form is formed by the second resonance circuit to a first uppermost resonance point.

To achieve the above objects, there is also provided a method for addressing a PDP at a high speed including the steps of: forming a first resonance circuit so that a half voltage of a driving voltage of the PDP charged in a capacitor can flow to the PDP; discharging the PDP from the time point when a resonance wave form is formed by the first resonance circuit to a first lowermost resonance point; sustaining a voltage charged in the PDP; forming a second resonance circuit for charging the electric charge discharged from the PDP; and discharging the PDP from the time point when a resonance wave form is formed by the second resonance circuit to a first uppermost resonance point.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 9A:
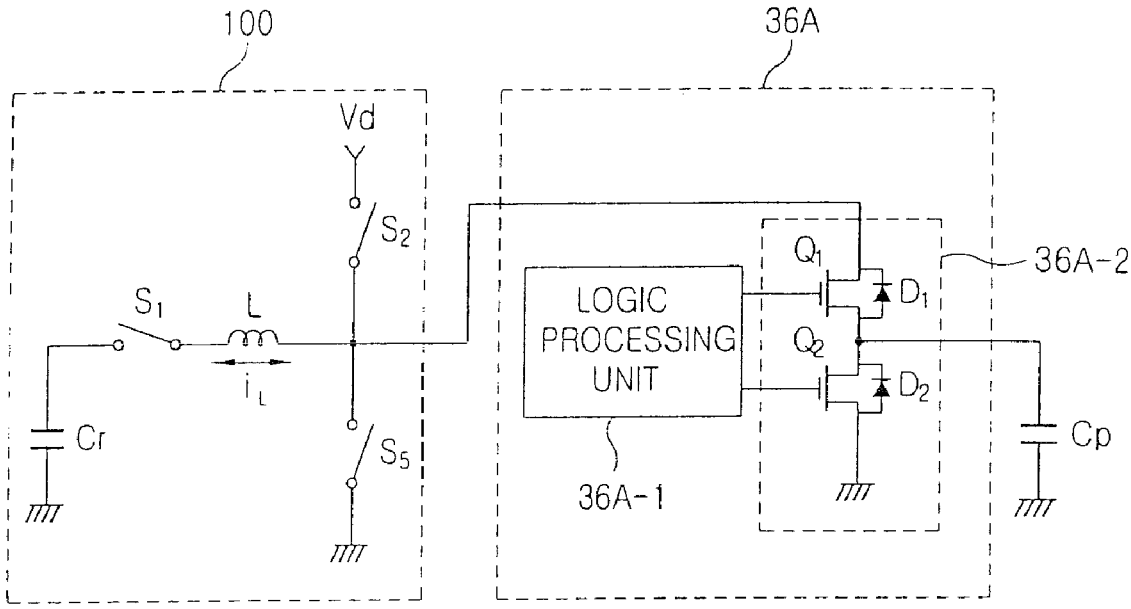
FIG. 9A is a circuit diagram of a PDP energy recovery apparatus in accordance a first embodiment of the present invention.

FIG. 9A is a circuit diagram of a PDP energy recovery apparatus in accordance a first embodiment of the present invention.

As shown in the drawing, a PDP energy recovery apparatus of the present invention includes a panel capacitor Cp as an equivalent circuit element to a PDP, an address driving unit 36A for controlling driving of the PDP, and the PDP energy recovery circuit unit 100 for recovering energy of the panel capacitor Cp.

The address driving unit 36A implemented as an integrated circuit includes a logic processing unit 36A-1 for processing a small signal and a high voltage processor 36A-2 having FETs Q1 and Q2 for receiving output signals of the logic processing unit 36A-1 to their gates and switching according to the inputted signal and parasitic diodes D1 and D2 respectively connected with the FETs Q1 and Q2.

The PDP energy recovery circuit unit 100 includes an energy recovery capacitor Cr for charging energy recovered from the panel capacitor Cp, a coil L connected with the energy recovery capacitor Cr and the panel capacitor Cp to make a resonance with the panel capacitor Cp, a first switch S1 for switching charge and discharge of the energy recovery capacitor Cr, and a second switch S2 for switching supply of a power Vd to the panel capacitor Cp.

Figure 9B:
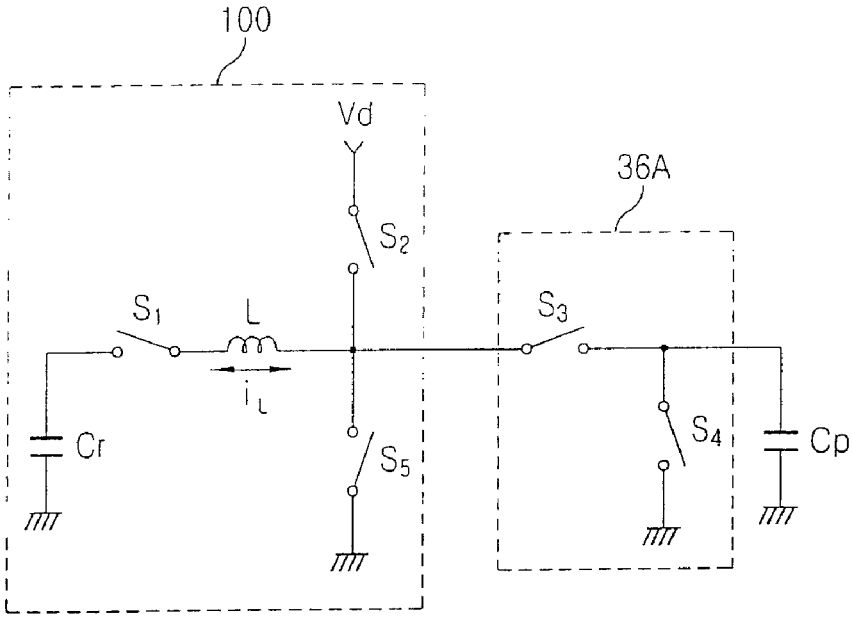
FIG. 9B is an equivalent circuit diagram of the PDP energy recovery apparatus of FIG. 9A in accordance with the first embodiment of the present invention.

FIG. 9B is an equivalent circuit diagram of the PDP energy recovery apparatus of FIG. 9A in accordance with the first embodiment of the present invention, which shows a third switch S3 and a fourth switch S5 equivalent to the logic processing unit, the FETs and the parasitic diodes of the address driving unit 36A.

Figure 1:
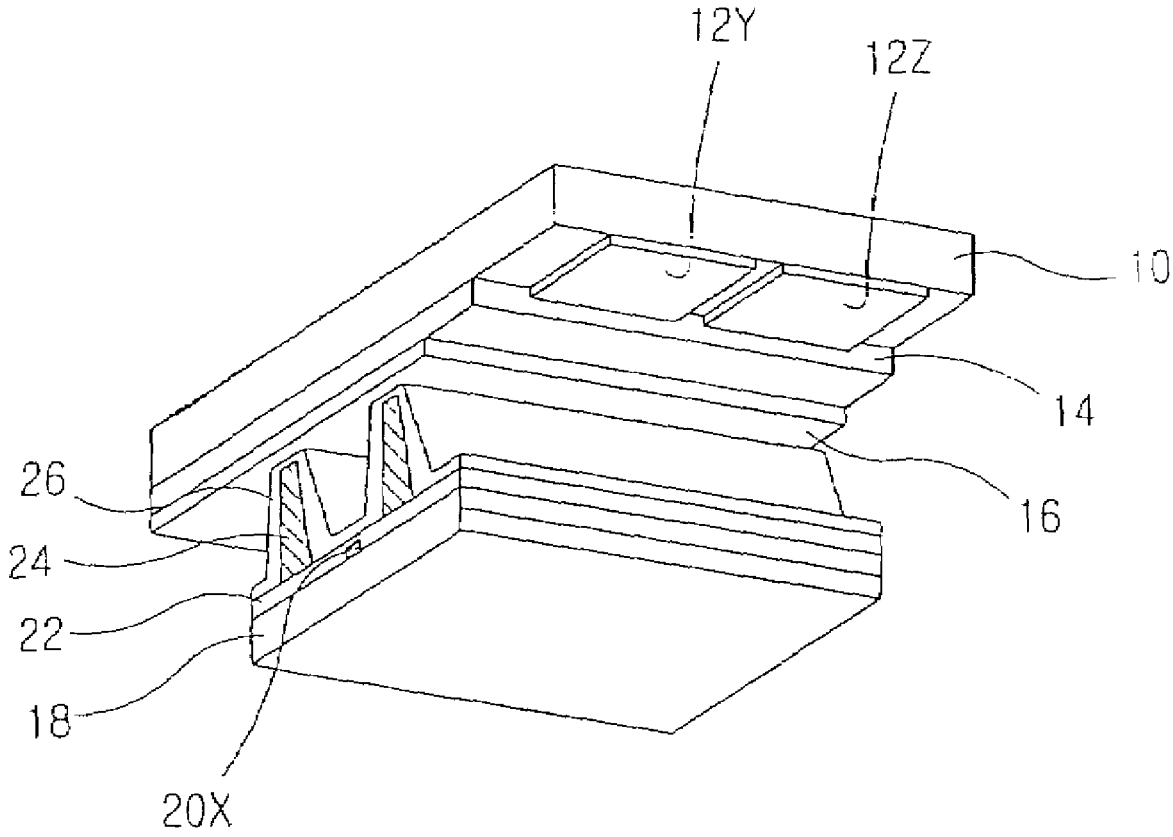
FIG. 1 CONVENTIONAL ART
FIG. 1 is a perspective view of a structure of a face discharge type PDP in accordance with a conventional art.
Figure 2:
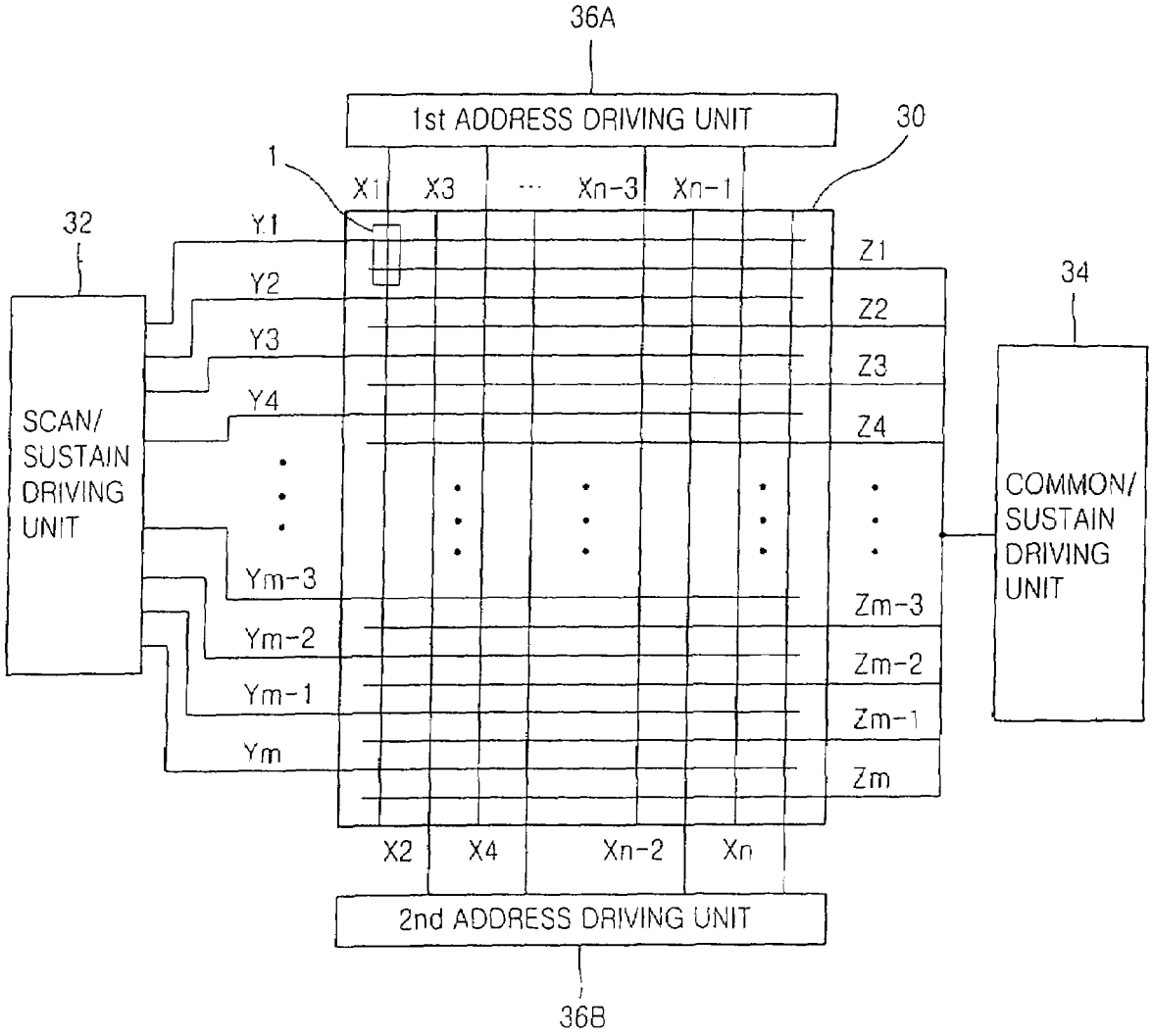
FIG. 2 CONVENTIONAL ART
FIG. 2 illustrates a construction of a driving unit of an AC face discharge type PDP in accordance with the conventional art.
Figure 3:
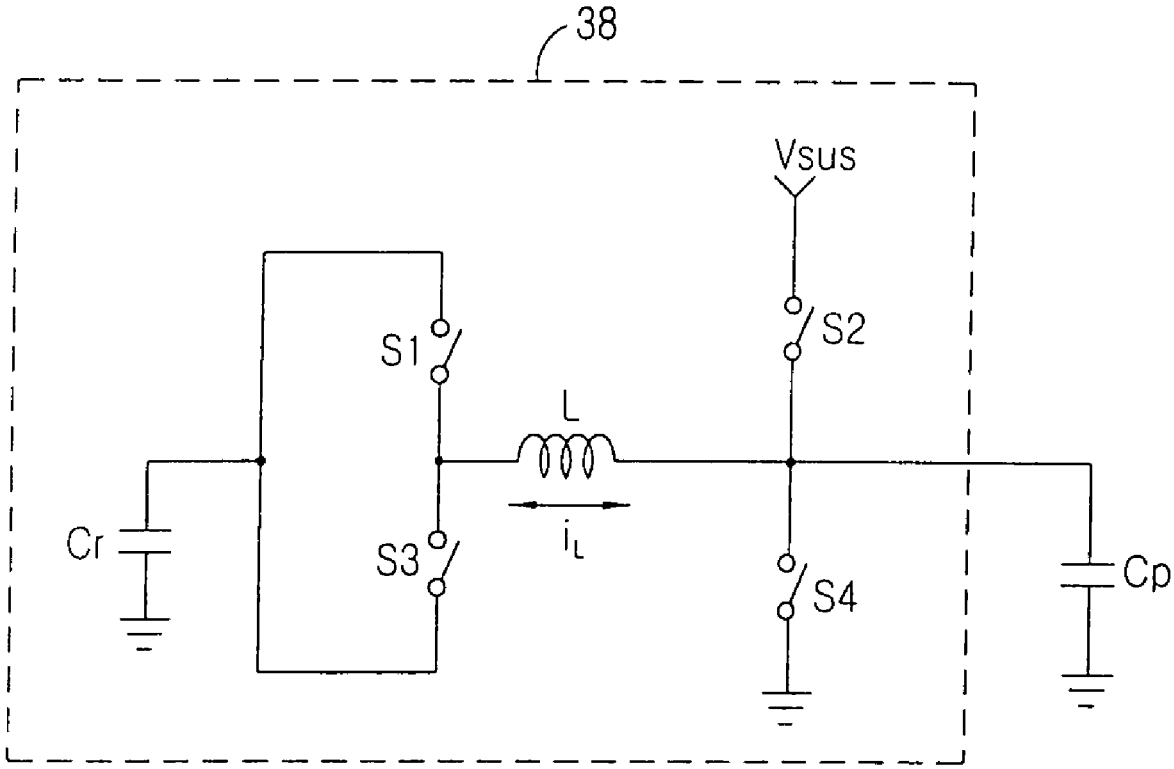
FIG. 3 CONVENTIONAL ART
FIG. 3 is a circuit diagram of a PDP energy recovery apparatus in accordance with a first embodiment of the conventional art.
Figure 4:
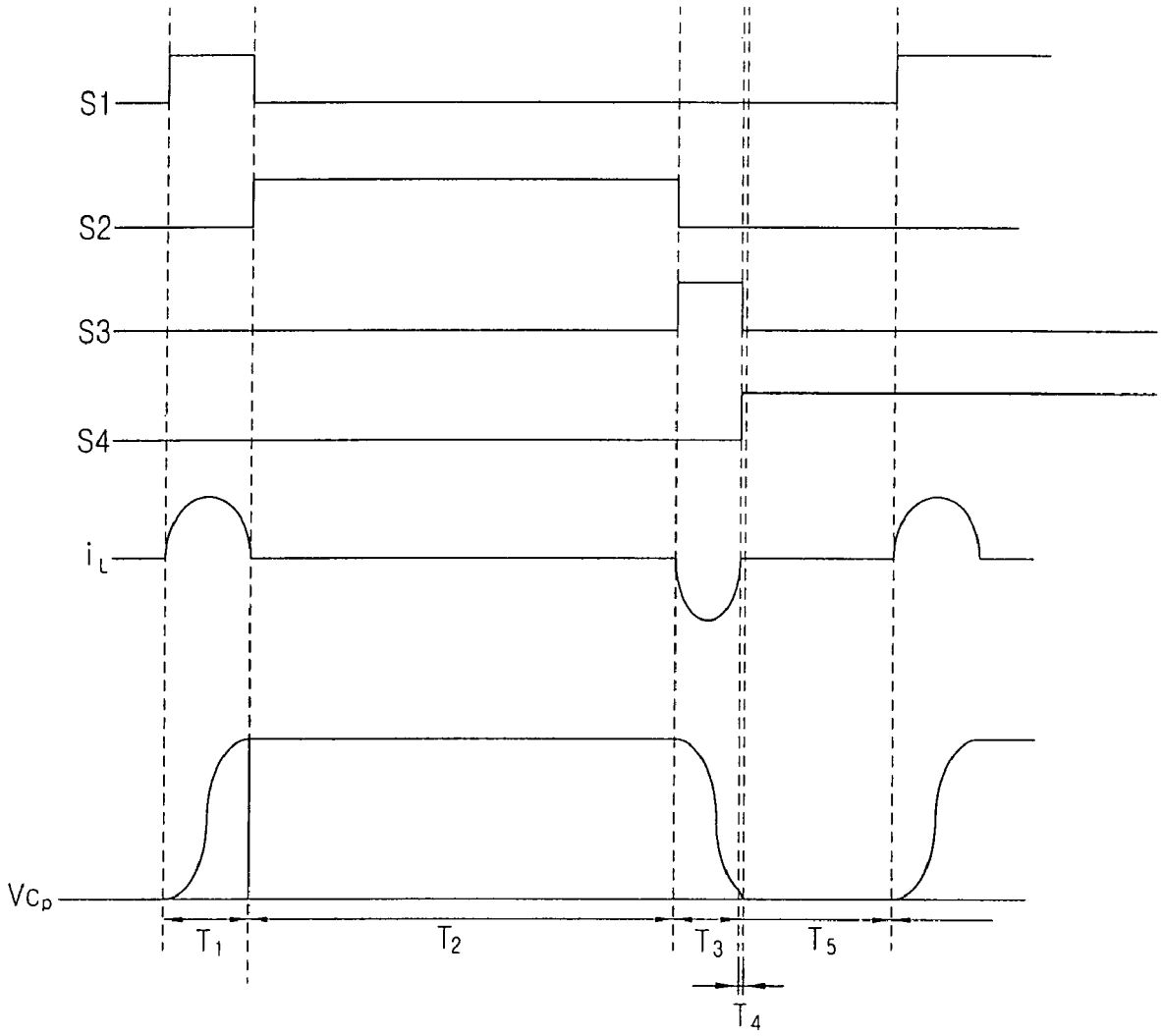
FIG. 4 CONVENTIONAL ART
FIG. 4 illustrates operational wave forms of the PDP energy recovery apparatus in accordance with the first embodiment of the conventional art.

The second address driving unit (the block 36B of FIG. 2) may be installed to be connected with the PDP energy recovery circuit unit 100, like the address driving unit 36A.

The operation of the PDP energy recovery apparatus of the present invention constructed as described above will now be explained.

Figure 10:
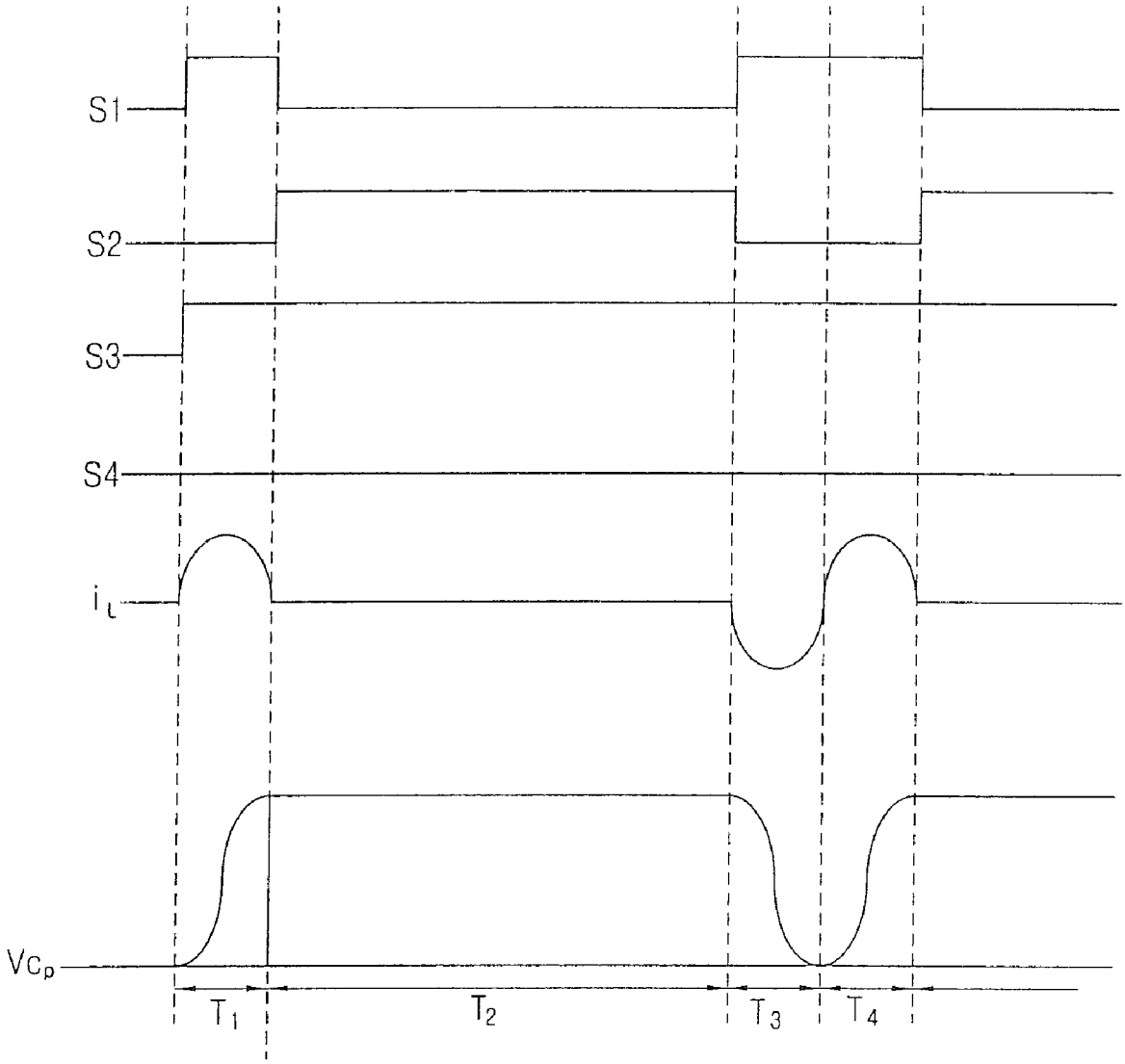
FIG. 10 illustrates wave forms of the PDP energy recovery apparatus of FIG. 9A or FIG. 9B in accordance with the first embodiment of the present invention.

FIG. 10 illustrates wave forms of the PDP energy recovery apparatus of FIG. 9A or FIG. 9B in accordance with the first embodiment of the present invention.

Let's assume that a voltage charged between the address electrode lines X before the T1 interval, that is, the voltage charged in the panel capacitor Cp is '0' and a voltage charged in the energy recovery capacitor Cr is Vd/2.

At the T1 interval, when the first and the third switches S1 and S3 are turned on, a current path is formed from the energy recovery capacitor Cr through the first switch S1, the coil L and the third switch S3 and to the panel capacitor Cp, and the coil L and the panel capacitor Cp forms a serial resonance circuit. In this respect, if no pulse is applied to the address electrode line (that is, the PDP discharge cell is not selected), the third switch S3 is maintained at an OFF state.

Since the coil L and the panel capacitor Cp forms the serial resonance circuit, the voltage of the panel capacitor VCp goes up to the voltage Vd which is twice of the voltage Vd/2 of the energy recovery capacitor Cr.

At a T2 interval, the first switch S1 is turned off and the address voltage is continuously supplied to the address electrode line, maintaining the address voltage in the state that the switch S2 is turned on.

At a T3 interval, the second switch S2 is turned off and the first switch S1 is turned on. Then, a current path is formed from the panel capacitor Cp through the third switch S3, the coil 'L', the first switch S1 to the energy recovery capacitor Cr, so that the voltage charged in the panel capacitor Cp is discharged to the energy recovery capacitor Cr.

When the panel capacitor Cp discharges, the voltage VCp of the panel capacitor Cp goes down, and at the same time, a voltage of Vd/2 is charged in the energy recovery capacitor Cr. At this time, since the first switch S1 is maintained at the turned on state, a current path is formed from the energy recovery capacitor Cr through the first switch S1, the coil L and the third switch S3 to the panel capacitor Cp. That is, like at the T1 interval, the voltage of Vd/2 is charged in the energy recovery capacitor Cr and then is started to be discharged to the panel capacitor Cp.

Accordingly, the data pulse supplied to the address electrode lines is obtained as the operation are repeatedly performed periodically by the switches at the T1~T3 intervals.

Meanwhile, the fourth and the fifth switches S4 and S5 are turned on when the data pulse is not supplied to the address electrode. The current iL flowing to the coil L is a resonance current which is generated when the panel capacitor Cp is charged and discharged.

Figure 11A:
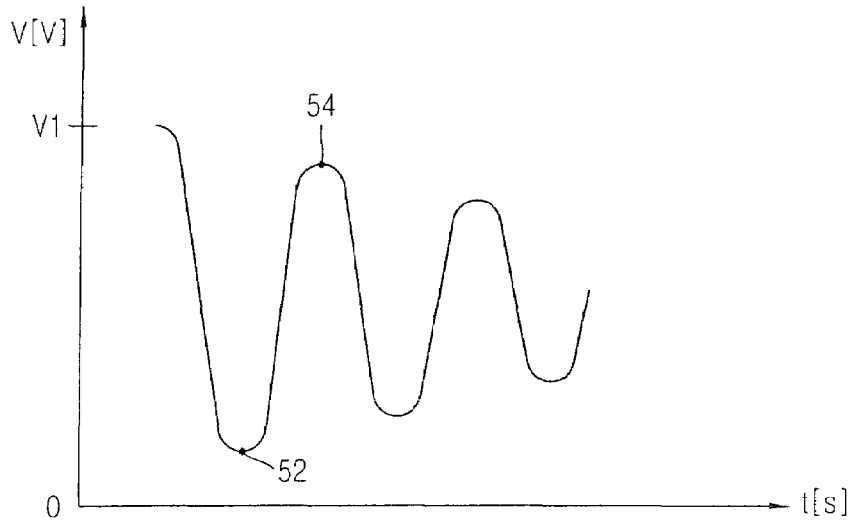
FIGS. 11A and 11B illustrate detailed wave forms of the T4 and T1 intervals of FIG. 10 in accordance with the first embodiment of the present invention.
Figure 11B:
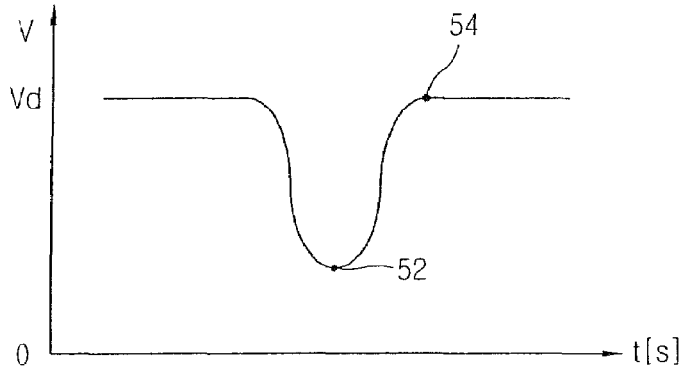

FIGS. 11A and 11B illustrate detailed wave forms of the T3 and T1 intervals of FIG. 10 in accordance with the first embodiment of the present invention.

At a T3 interval where the first switch S1 is turned on, as shown in FIG. 11A, a resonance circuit is formed by the coil L and the energy recovery capacitor Cr, generating a resonance wave form.

That is, the energy recovery capacitor Cr is charged until the resonance wave form goes down to the first resonance point 52 and then is started to be discharged. At this time, since the first switch S1 is in the turned on state, the resonance wave form is generated by the resonance circuit which is formed by the coil L and the panel capacitor Cp.

After the resonance wave form generated by the coil L and the panel capacitor Cp goes up to the second resonance point 54, when the second switch S2 is turned on, a wave form as shown in FIG. 11B is generated.

Therefore, the PDP energy recovery circuit unit 100 of the present invention can generate a data pulse without a set time (or grounding time) between the charge and discharge time, that is, a delay time, by charging and discharging at the first resonance point 52 and the second resonance point 54 of the resonance wave form.

Figure 12:
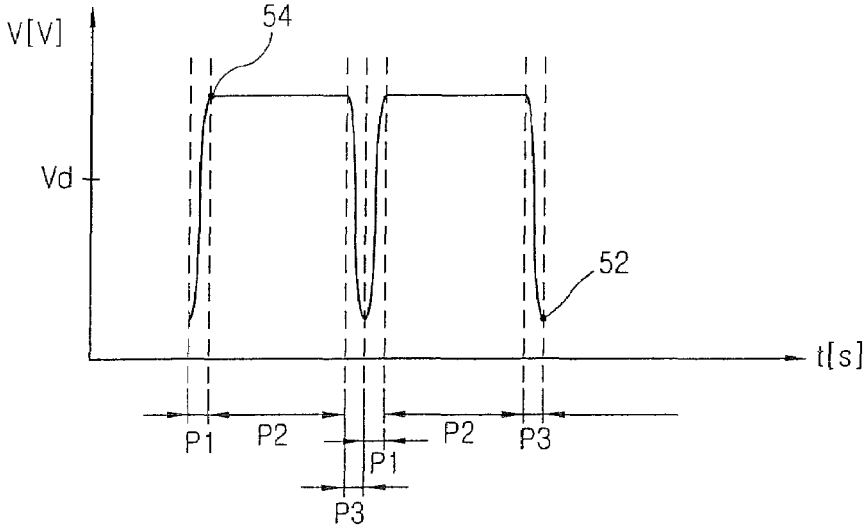
FIG. 12 illustrate a wave form of a data pulse of the PDP energy recovery apparatus in accordance with the first embodiment of the present invention.

FIG. 12 illustrate a wave form of a data pulse of the PDP energy recovery apparatus in accordance with the first embodiment of the present invention.

The wave form of the data pulse of the PDP energy recovery apparatus is divided into a P1 interval (corresponding to the T1 interval of FIG. 10) where the panel capacitor Cp is charged, a P2 interval (corresponding to the T2 interval of FIG. 10) where the data pulse is supplied to the address electrode line, and a P3 interval (corresponding to the T3 of FIG. 10) where the voltage charged in the panel capacitor Cp is recovered and charged in the energy recovery capacitor Cr.

Figure 8:
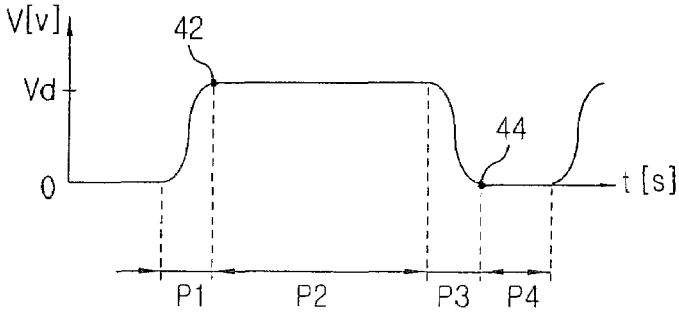
FIG. 8 CONVENTIONAL ART
FIG. 8 illustrate a wave form of a data pulse of the PDP energy recovery apparatus in accordance with the conventional art.

The data pulse wave of the present invention does not have such a P4 interval of FIG. 8 where the voltage of the panel capacitor Cp goes down to '0' as in the data pulse wave form of the conventional art.

Figure 13:
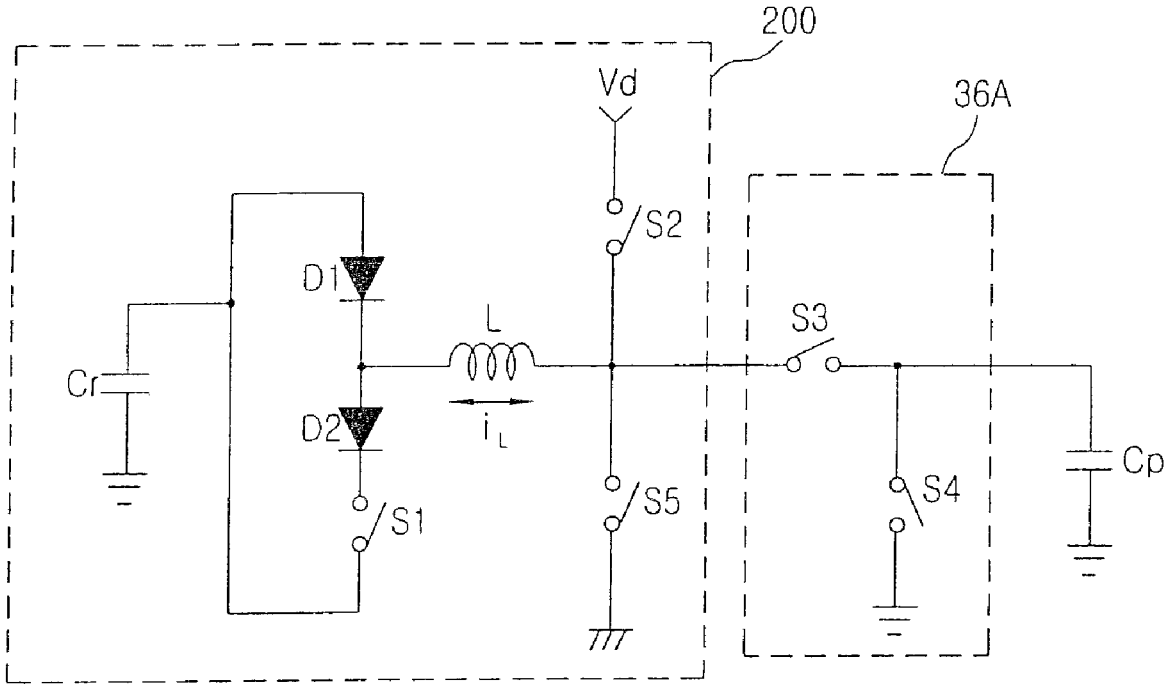
FIG. 13 is a circuit diagram of a PDP energy recovery apparatus in accordance with a second embodiment of the present invention.

FIG. 13 is a circuit diagram of a PDP energy recovery apparatus in accordance with a second embodiment of the present invention, which includes a panel capacitor Cp as an equivalent circuit element to the PDP, an address driving unit 36A for controlling driving of the PDP and a PDP energy recovery circuit unit 200 for recovering energy of the panel capacitor Cp.

The address driving unit 36A is the same as the address driving unit 36A of FIG. 9.

The PDP energy recovery circuit unit 200 includes an energy recovery capacitor Cr for charging and discharging energy from and to the panel capacitor Cp, a coil 'L' connected between the energy recovery capacitor Cr and the panel capacitor Cp to make a resonance with the panel capacitor Cp, a second switch S2 for switching supply of a power source (Vd) to the panel capacitor Cp, a first and a second diodes D1 and D2 connected in parallel between the coil L and the energy recovery capacitor Cr, and a first switch S1 for switching the current flowing from the second diode D2 and controlling the voltage charged in the energy recovery capacitor Cr.

The operation of the PDP energy recovery apparatus in accordance with the second embodiment of the present invention constructed as described above will now be explained.

Figure 14:
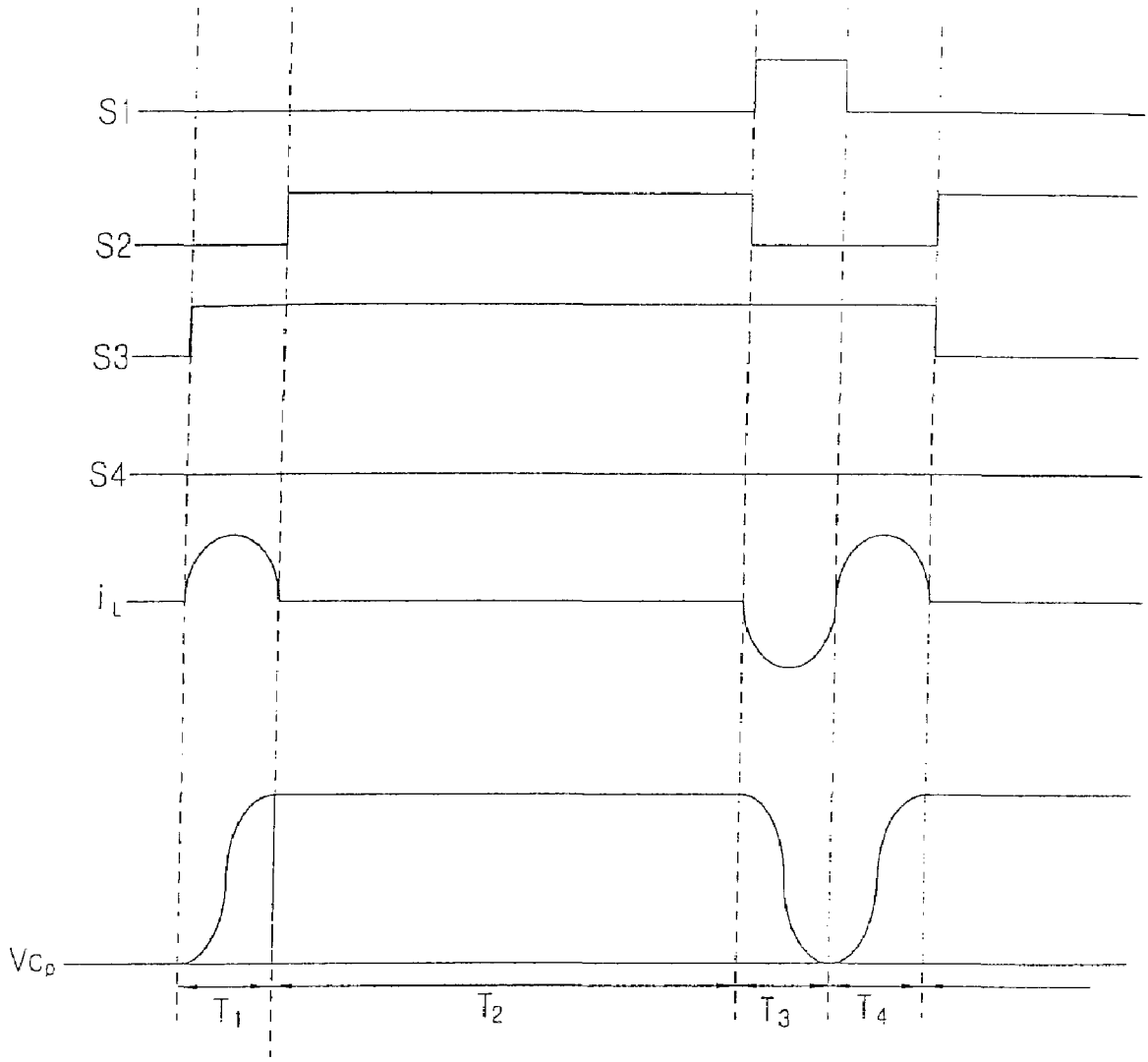
FIG. 14 illustrates wave forms of the PDP energy recovery apparatus of FIG. 13 in accordance with the second embodiment of the present invention.

FIG. 14 illustrates wave forms of the PDP energy recovery apparatus of FIG. 13 in accordance with the second embodiment of the present invention.

It is assumed that the voltage charged in the panel capacitor is '0' and the voltage charged in the energy recovery capacitor is Vd/2.

At a T1 interval, when the third switch S3 is turned on, a current path is formed from the energy recovery capacitor Cr through the first diode D1, the coil L and the third switch S3 to the panel capacitor Cp. At this time, since the coil L and the panel capacitor Cp forms a serial resonance circuit, the voltage of the panel capacitor Cp goes up to the address voltage Vd which is the twice voltage Vd/2 of the energy recovery capacitor Cr.

In this respect, if data pulse is supplied to the address electrode line 'X', the fourth switch S4 is maintained in a turned off state.

At a T2 interval, the address voltage supplied to the address electrode line is maintained.

At a T3 interval, the second switch S2 is turned off and the first switch S1 is turned on. Then, a current path is formed from the panel capacitor Cp through the third switch S3, the coil L, the second diode D2 and the first switch S1 to the energy recovery capacitor Cr, so that the voltage charged in the panel capacitor Cp is discharged to the energy recovery capacitor Cr.

As the panel capacitor Cp is continuously discharged, the voltage of the panel capacitor dropped further, and at the same time, the energy recovery capacitor is charged with a voltage of Vd/2.

After the energy recovery capacitor Cr is charged with the Vd/2 voltage, it starts to be discharged through the first diode D1 to the panel capacitor Cp.

Meanwhile, the fourth and the fifth switches S4 and S5 are turned on when no data pulse is supplied to the address electrode line. The current iL flowing to the coil L is a resonance current which is generated when the panel capacitor Cp is charged and discharged.

Accordingly, the data pulse supplied to the address electrode lines is obtained as the operation is repeatedly performed periodically by the switches at the T1~T3 intervals.

Figure 15:
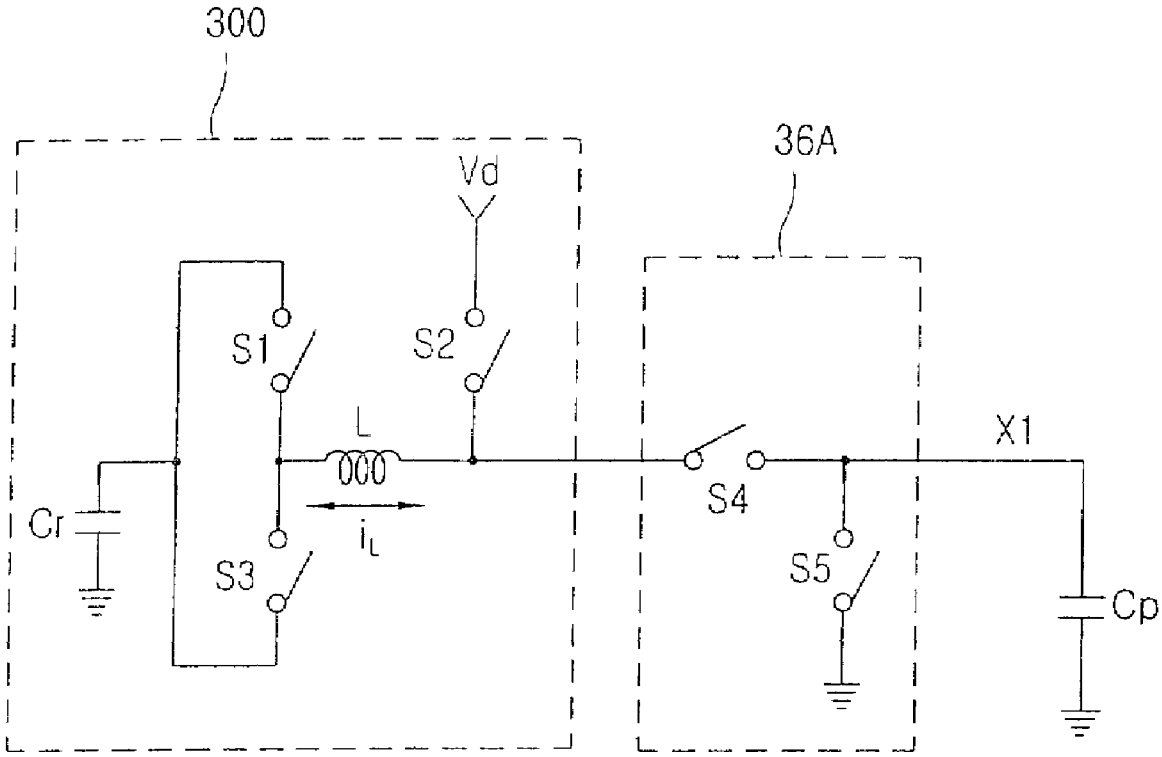
FIG. 15 is a circuit diagram of a PDP energy recovery apparatus in accordance with a third embodiment of the present invention.

FIG. 15 is a circuit diagram of a PDP energy recovery apparatus in accordance with a third embodiment of the present invention, which includes a panel capacitor Cp as an equivalent circuit element to the PDP, an address driving unit 36A for controlling driving of the PDP and a PDP energy recovery circuit unit 300 for recovering energy of the panel capacitor Cp.

The address driving unit 36A is the same as the address driving unit 36A of FIG. 9.

The PDP energy recovery circuit unit 300 includes an energy recovery capacitor Cr for charging and discharging energy from and to the panel capacitor Cp, a coil L connected between the energy recovery capacitor Cr and the panel capacitor Cp to make a resonance with the panel capacitor Cp, the first and the third switches S1 and S3 for switching charge and discharge of the energy recovery capacitor Cr, and a second switch S2 for switching supply of a power Vd to the panel capacitor Cp, The operation of the PDP energy recovery apparatus in accordance with the third embodiment of the present invention constructed as described above will now be explained.

Figure 16:
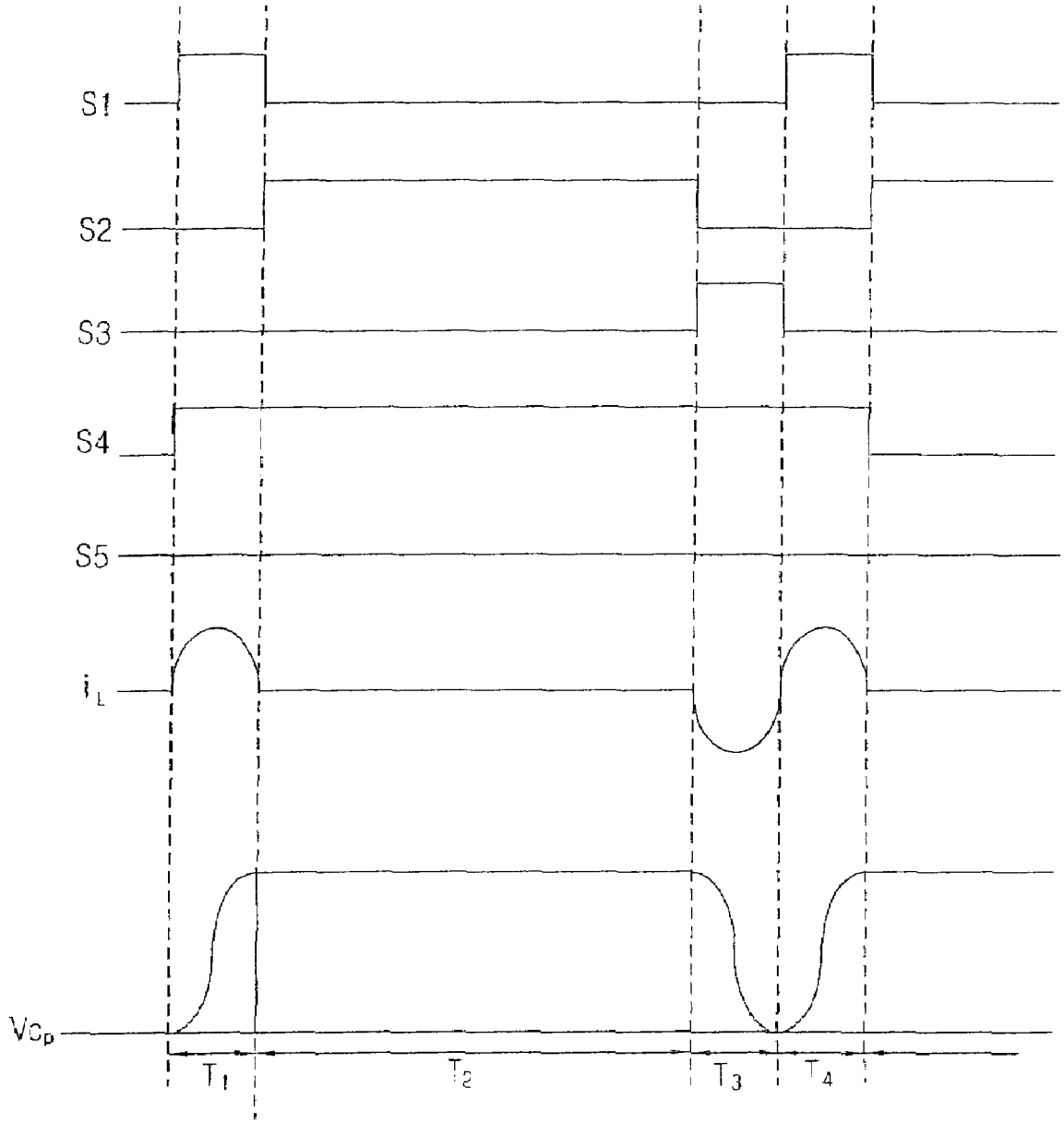
FIG. 16 illustrate operational wave forms of the PDP energy recovery apparatus of FIG. 15 in accordance with the third embodiment of the present invention.

FIG. 16 illustrate operational wave forms of the PDP energy recovery apparatus of FIG. 15 in accordance with the third embodiment of the present invention.

Let's assume that that the voltage charged in the panel capacitor is '0' and the voltage charged in the energy recovery capacitor is Vd/2.

At a T1 interval, the first and the fourth switches S1 and S4 are turned on.

Then, a current path is formed from the energy recovery capacitor Cr through the first switch S1, the coil L and the fourth switch S4 to the panel capacitor Cp, and the coil L and the panel capacitor Cp forms a serial resonant circuit. In this respect, if no data pulse is supplied to the address electrode line (that is, the PDP discharge cell is not selected), the fourth switch S4 is maintained at the turned off state.

Accordingly, since the coil L and the panel capacitor Cp forms the serial resonant circuit, the voltage VCp of the panel capacitor Cp goes up to the voltage Vd which is twice voltage (Vd/2) of the energy recovery capacitor Cr.

At a T2 interval, the first switch S1 is turned off and the address voltage Vd is continuously supplied to the address electrode line, maintaining the address voltage Vd in the state that the second switch S2 is turned on.

At a T3 interval, the second switch S2 is turned off and the third switch S3 is turned on. Then, a current path is formed from the panel capacitor Cp through the fourth switch S4, the coil L and the third switch S3 to the energy recovery capacitor Cr, so that the voltage charged in the panel capacitor Cp is discharged to the energy recovery capacitor Cr.

As the panel capacitor Cp discharges the electric charge, the voltage VCp of the panel capacitor goes down, and at the same time, the Vd/2 voltage is charged in the energy recovery capacitor Cr.

Accordingly, the data pulse supplied to the address electrode lines is obtained as the operation is repeatedly performed periodically by the switches at the T1~T3 intervals.

Figure 17:
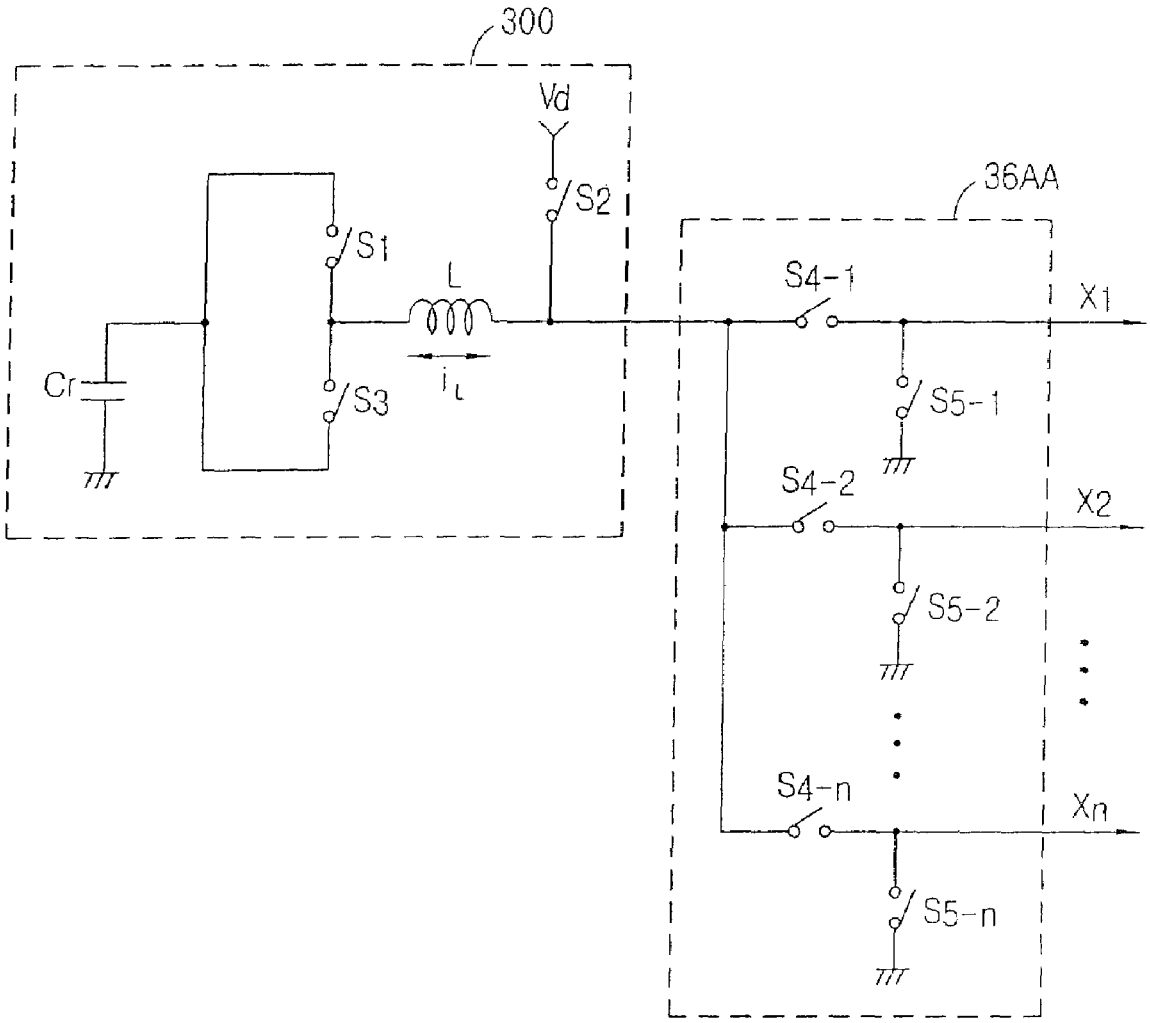
FIG. 17 is a circuit diagram of a PDP energy recovery apparatus in accordance with a fourth embodiment of the present invention.

FIG. 17 is a circuit diagram of a PDP energy recovery apparatus in accordance with a fourth embodiment of the present invention, in which substantially, a plurality of address electrode lines of the PDP are connected in the address driving unit.

As shown in the drawing, the PDP energy recovery apparatus of the present invention includes an address driving unit 36AA connected with address electrode lines (X1, X2, . . . , Xn) of a PDP (not shown), for controlling driving of PDP cells, and a PDP energy recovery circuit unit 300 for recovering energy of the PDP.

The address driving unit 36AA includes address electrode switches (S4-1, S4-2, . . . , S4-n) for switching the address electrode lines (X1, X2, . . . , Xn) and the ground switches (S5-1, S5-2, . . . , S5-n) for grounding the PDP cells.

The operation of the PDP energy recovery apparatus in accordance with the fourth embodiment of the present invention constructed as described above will now be explained.

Figure 18A:
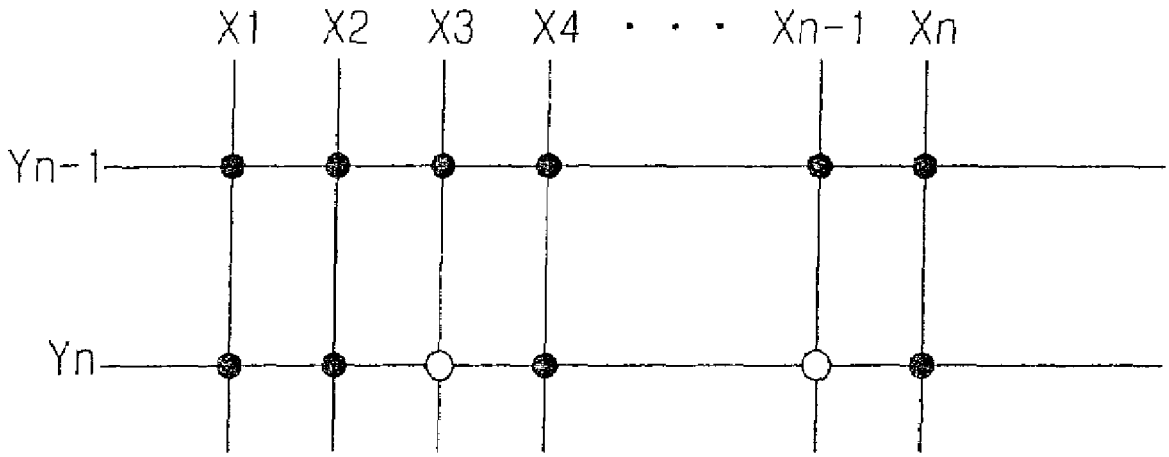
FIGS. 18A and 18B illustrate PDP cells displaying address data supplied to the n−1th and nth scan/sustain electrode lines (Yn−1, Yn) in accordance with the fourth embodiment of the present invention.
Figure 18B:
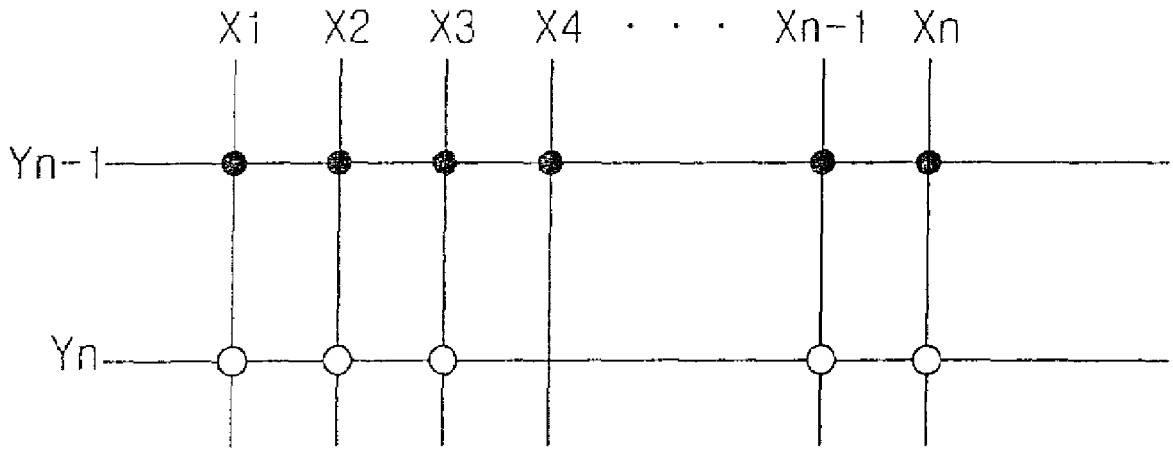

FIGS. 18A and 18B illustrate PDP cells displaying address data supplied to the n−1−th and n−th scan/sustain electrode lines (Yn−1, Yn) in accordance with the fourth embodiment of the present invention.

First, an address data is supplied to every discharge cell of the n−1−th scan/sustain electrode line (Yn−1).

Next, an address data is supplied to some PDP discharge cells in the n-th scan/sustain electrode line (Yn). That is, the address data is not supplied to the third and the n−1−th address electrode lines (X3, Xn−1).

At this time, the voltage which has been charged in the third and the n−1−th address electrode lines (X3, Xn−1) to which no address data is supplied is recovered to the energy recovery capacitor Cr.

The voltage, which is not recovered to the energy recovery capacitor, is recovered to the energy recovery capacitor through an inner diode (not shown) of a switch (S4-i) formed in the address driving unit 36AA.

With reference to FIG. 18B, the address data is supplied to none of the PDP discharge cells of the n-th scan/sustain electrode lines.

In case that the address data is not supplied, the voltage charged in the first through the n−th address electrode lines (X1~Xn) is recovered to the energy recovery capacitor.

Accordingly, in the PDP energy recovery apparatus of the present invention, after the voltage is recovered, grounding process of the PDP is not performed. Thus, the reference voltages recovered to the energy recovery capacitor are varied depending on the address data (that is, depending on the change amount of the address data) supplied to the address electrode lines, according to which the charged voltage values are different.

Figure 5A:
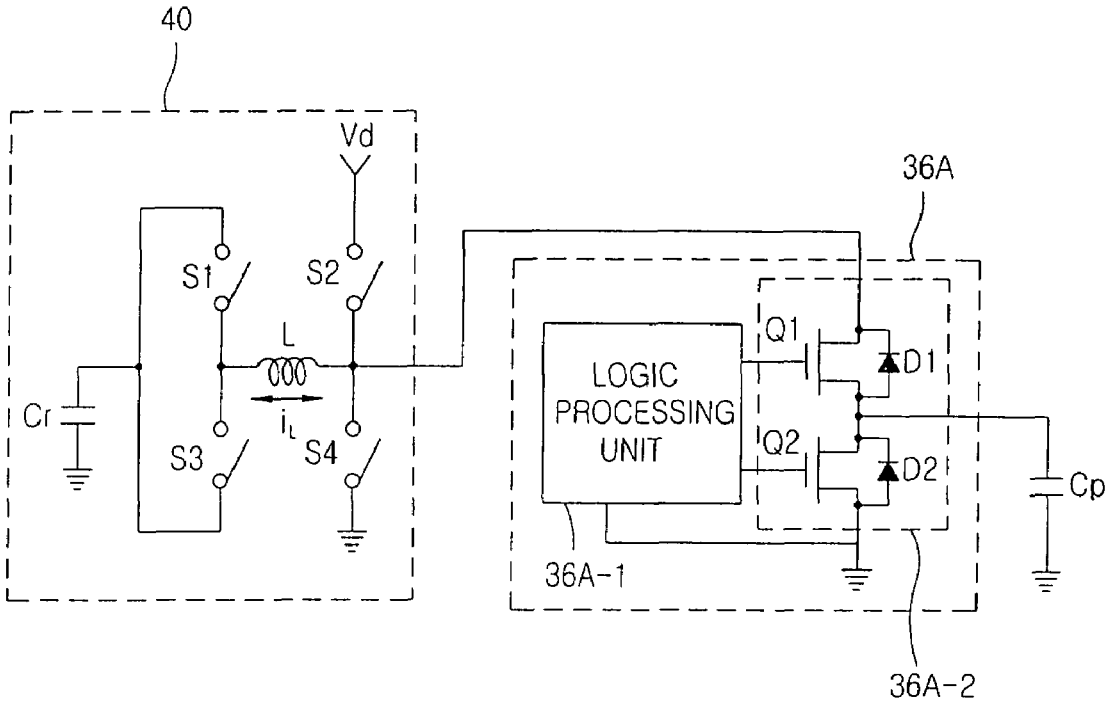
FIG. 5A CONVENTIONAL ART
FIG. 5A is a circuit diagram of a PDP energy recovery apparatus in accordance with a second embodiment of the conventional art.
Figure 5B:
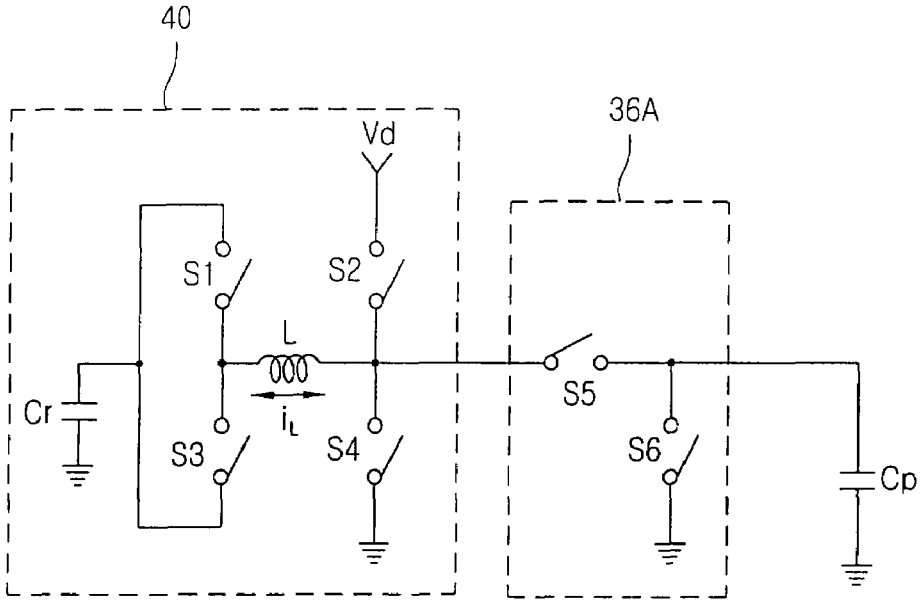
FIG. 5B CONVENTIONAL ART
FIG. 5B is an equivalent circuit diagram of the PDP energy recovery apparatus of FIG. 5A in accordance with the second embodiment of the conventional art.
Figure 6:
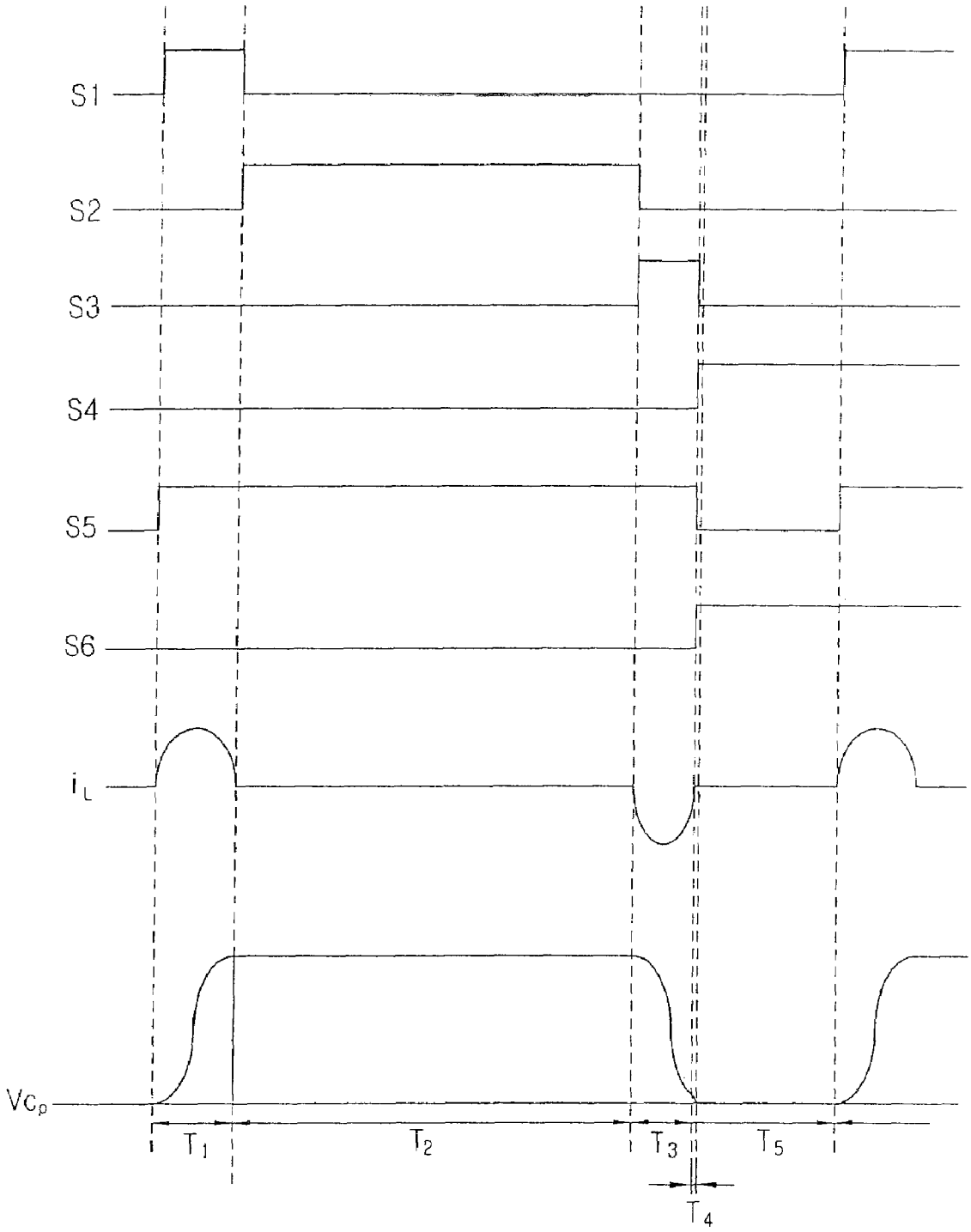
FIG. 6 CONVENTIONAL ART
FIG. 6 illustrates operational wave forms of a data pulse of the PDP energy recovery apparatus of FIG. 5A or FIG. 5B in accordance with the second embodiment of the conventional art.
Figure 7A:
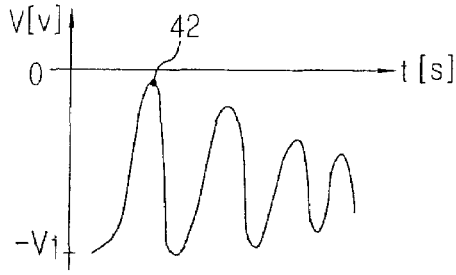
FIG. 7A CONVENTIONAL ART
FIGS. 7A through 7D illustrate wave forms at T1~T4 intervals of FIG. 6 in accordance with the second embodiment of the conventional art.
Figure 7B:
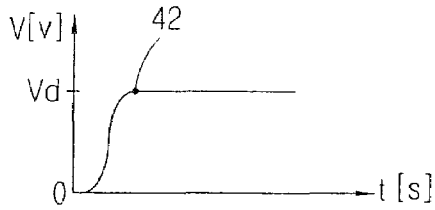
FIG. 7B CONVENTIONAL ART
Figure 7C:
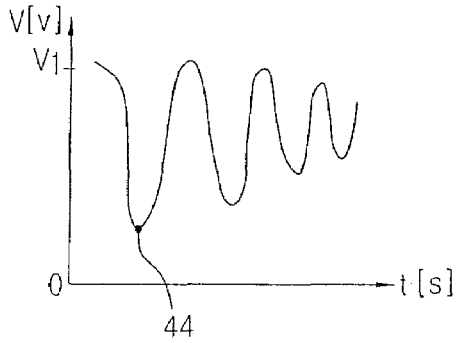
FIG. 7C CONVENTIONAL ART
Figure 7D:
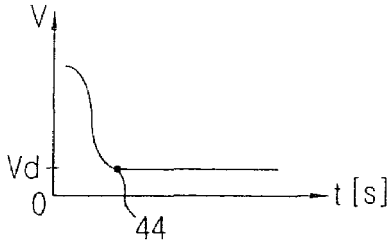
FIG. 7D CONVENTIONAL ART

Comparatively, in the conventional energy recovery apparatus, as shown in FIG. 5, after the voltage is recovered, since the fourth switch S4 shots to the ground, the voltage of the energy recovery capacitor Cr is maintained at Vd/2 continuously.

Figure 19A:
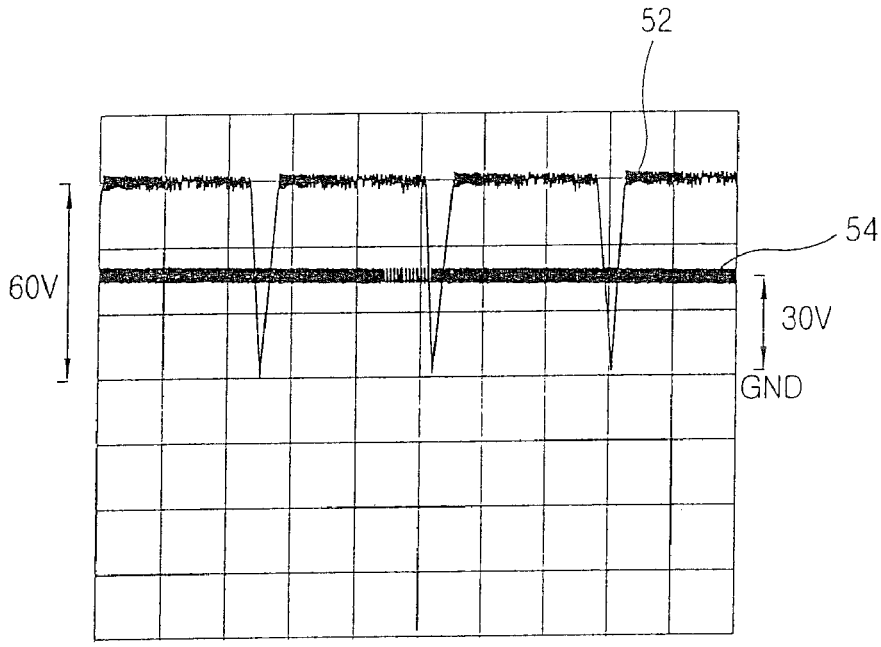
FIGS. 19A through 19C are graphs showing voltages charged in an energy recovery capacitor depending on the change of an address data on the assumption that the address voltage is 60V.
Figure 19B:
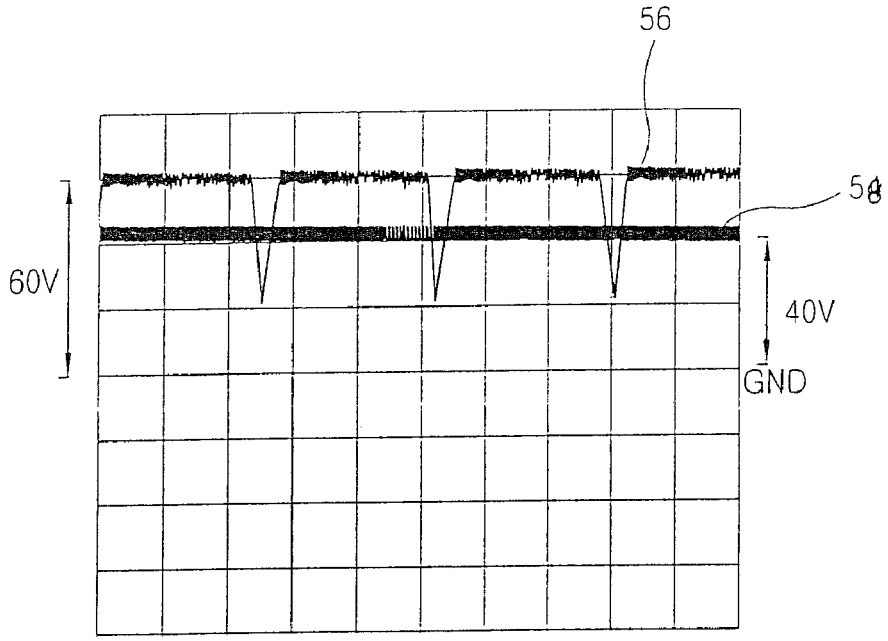
Figure 19C:
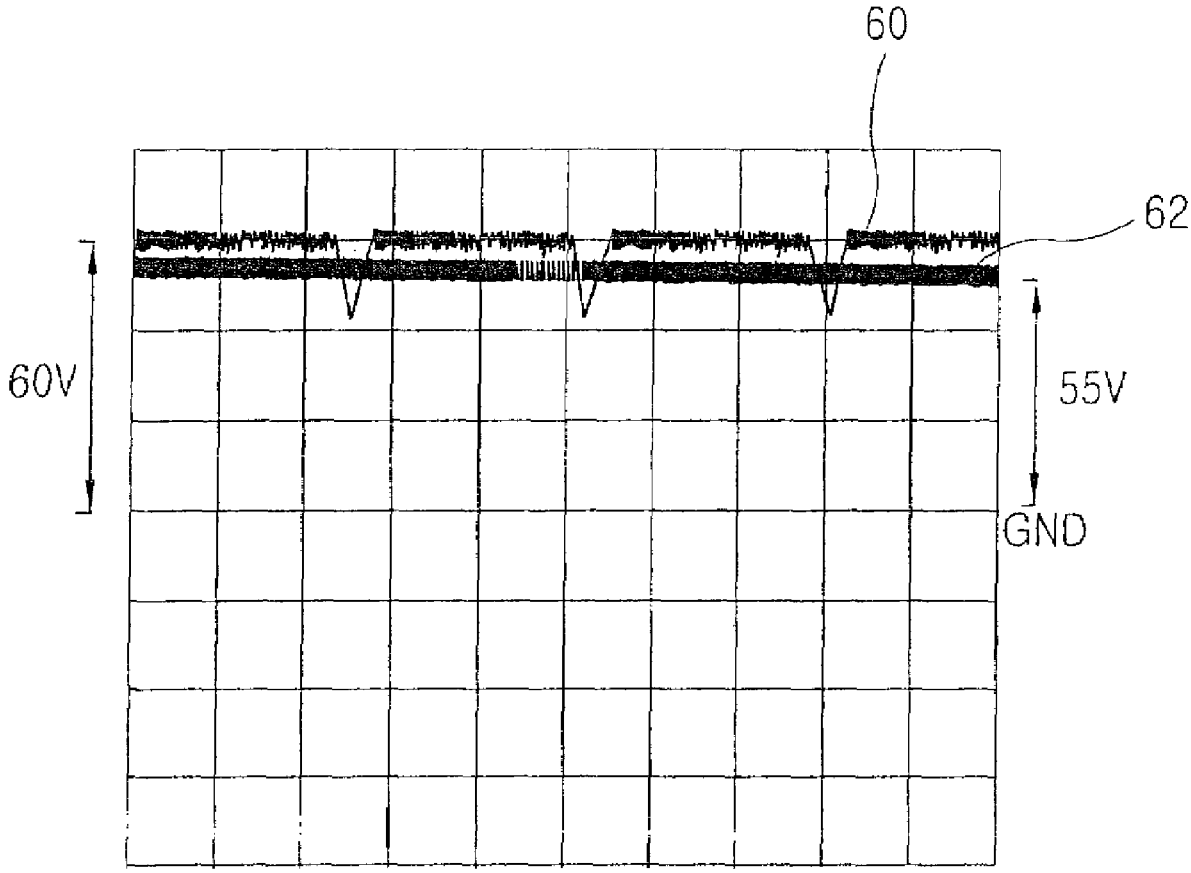

FIGS. 19A through 19C are graphs showing output voltage and reference voltages charged in an energy recovery capacitor Cr depending on changes of address data, for example, the voltage of the address data of 60V.

FIG. 19A is a graph showing the output data (wave form 52) and a voltage (wave form 54) charged in the energy recovery capacitor Cr in case that the address data is continuously changed as the address data is supplied to the address electrode line in an interlacing manner.

When the address data is supplied to the address electrode line 'X' and continuously changed, if the voltage of the energy recovery capacitor Cr as a reference voltage is set at about 30V, or ½ of the address voltage (Vd=60), then the voltages charged in and discharged from the PDP energy recovery apparatus are balanced at the voltage of 30V.

FIG. 19B is a graph showing the output voltage (wave form 56) and a voltage (wave form 58) charged in the energy recovery capacitor Cr in case that the address data supplied to the address electrode line is moderately changed.

If the voltage of the energy recovery capacitor Cr as a reference voltage is set about 40V, then the voltages charged in and discharged from the PDP energy recovery apparatus are balanced at the voltage of 30V.

FIG. 19C is a graph showing the output data (wave form 60) and a voltage (wave form 62) charged in the energy recovery capacitor Cr in case that the address data is continuously changed as the address data is supplied to the address electrode line.

If the voltage of the energy recovery capacitor Cr as a reference voltage is set about 55V, then the voltages charged in and discharged from the PDP energy recovery apparatus are balanced at the voltage of 55V.

When a full white data is supplied to the address electrode line, that is, there is no change in the address data, 60V of voltage, the address voltage, is charged in the energy recovery capacitor Cr, and the voltage charged in the panel capacitor is not discharged to the energy recovery capacitor.

That is, when the full white data is supplied, since the PDP energy recovery apparatus is not operated, the voltage of the energy recovery capacitor goes up to the address voltage (60V).

Accordingly, in the PDP energy recovery apparatus of the present invention, according to the change in the address data, the energy is effectively recovered from the PDP and charged to the energy recovery capacitor, and the voltage charged in the energy recovery capacitor is supplied back to the PDP.

Figure 20:
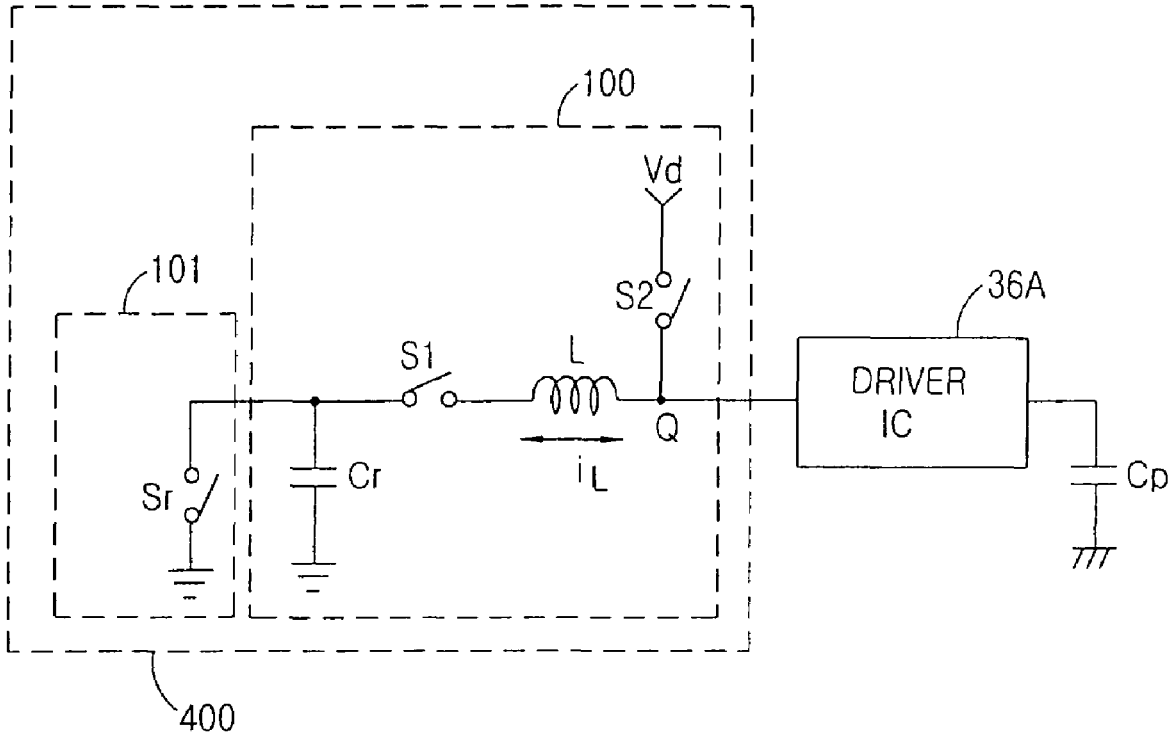
FIG. 20 is a circuit diagram of a PDP energy recovery apparatus in accordance with a fifth embodiment of the present invention.

FIG. 20 is a circuit diagram of a PDP energy recovery apparatus in accordance with a fifth embodiment of the present invention, which includes a panel capacitor Cp as an equivalent circuit element to the PDP, an address driving unit 36A for controlling driving of the PDP, and an improved PDP energy recovery circuit unit 400 for recovering the energy of the panel capacitor Cp.

As shown in FIG. 9, the address driving unit 36A is implemented as an integrated circuit, like the foregoing explanation.

The improved PDP energy recovery circuit unit 400 includes, for example, the PDP energy recovery circuit unit 100 as shown in FIG. 9, and an initialization switch Sr 101 for grounding the energy recovery capacitor Cr included in the PDP energy recovery circuit unit 100.

Here, instead of the PDP energy recovery circuit unit 100, the PDP energy recovery circuit unit 200 or 300 in the PDP energy recovery apparatuses of the present invention in FIGS. 13 and 15 may be used.

The initialization switch 101 Sr lowers the potential of the energy recovery capacitor Cr to maintain Vd/2 voltage when the voltage charged in the energy recovery capacitor Cr is initialized or while the energy recovery capacitor Cr recovers the energy. That is, in order to lower the node Q between the coil L and the panel capacitor Cp to the ground level, the energy down sustaining operation is to be performed. But, in the first to fourth embodiments of the present invention, the energy down sustaining operation is not performed, resulting in that the charge value is automatically changed according to the data amount of the energy recovery capacitor Cr. Accordingly, since there is no interval where the node 'Q' goes down to the ground level, the level of the energy charged in the energy recovery capacitor Cr may continuously go up. In this respect, the driver IC may lower the potential of the node 'Q' if there is many low data, it is not effective to perform the operation of directly grounding the node 'Q'.

For this purpose, to lower the voltage level of the node 'Q', a method is taken in which the energy recovery capacitor Cr is grounded through the initialization switch 101 Sr of the improved PDP energy recovery circuit unit 400 while the energy recovery capacitor is not discharged after being charged.

In order to ground the PDP energy recovery capacitor, the operation time point of the initialization switch Sr will now be described.

Figure 21:
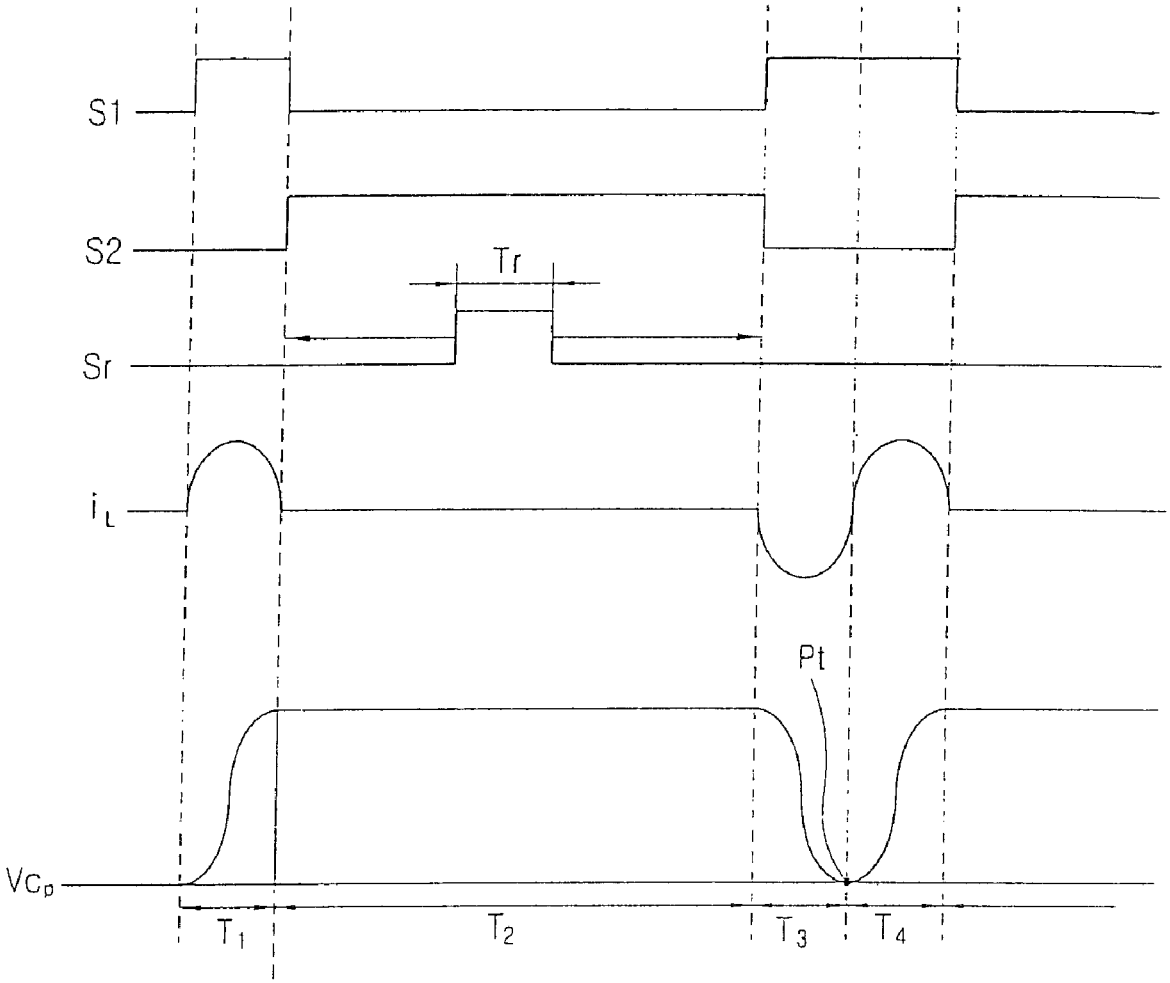
FIG. 21 illustrates operational wave forms of the PDP energy recovery apparatus in accordance with the fifth embodiment of the present invention.

FIG. 21 illustrates operational wave forms of the PDP energy recovery apparatus in accordance with the fifth embodiment of the present invention.

Let's assume that, before the T1 interval, the voltage charged between the address electrode lines 'X', that is, the voltage charged in the panel capacitor Cp is '0' and the voltage of the energy recovery capacitor Cr is Vd/2.

At a T1 interval, when the first switch S1 is turned on, a current path is formed from the energy recovery capacitor Cr through the first switch S1, the coil L and the driver IC 36A to the panel capacitor Cp, and the coil L and the panel capacitor forms a serial resonance circuit.

Since the coil L and the panel capacitor Cp forms the serial resonance circuit, the voltage VCp of the panel capacitor goes up to the voltage Vd which is twice of the voltage Vd/2 of the energy recovery capacitor Cr.

At a T2 interval, the first switch S1 is turned off and the address voltage keeps supplying to the address electrode line, so that the address voltage is maintained.

At a T3 interval, the second switch S2 is turned off and the first switch S1 is turned on. Then, a current path is formed from the panel capacitor Cp through the driver IC 36A, the coil L and the first switch S1 to the energy recovery capacitor Cr, so that the voltage charged in the panel capacitor Cp is discharged to the energy recovery capacitor Cr.

When the panel capacitor Cp discharges electric charge, the voltage Vcp of the panel capacitor goes down, and at the same time, the voltage of Vd/2 is charged in the energy recovery capacitor Cr. At this time, the first switch S1 is maintained at the ON state, a current path is formed from the energy recovery capacitor Cr through the first switch S1, the coil and the driver IC 36A to the panel capacitor Cp.

That is, like in the T1 interval, the voltage of Vd/2 is charged in the energy recovery capacitor Cr and then discharged to the panel capacitor Cp.

Accordingly, the data pulse supplied to the address electrode lines is obtained as the operation are repeatedly performed periodically by the switches at the T1~T3 intervals.

The fourth and the fifth switches are turned on when the data pulse is not supplied to the address electrode line. The current iL flowing to the coil is a resonance current generated when the panel capacitor Cp is charged and discharged.

Since the node 'Q' does not have a chance to be grounded to the voltage of the ground level, the resonance point (Pt) between the T1 and T3 has a tendency that it continuously goes up.

Accordingly, in a state that the first switch S1 is turned on, the voltage Vd is applied through the driver IC 36A to the PDP, and at the T2 interval where the first switch S1 is turned off, the initialization switch Sr grounds the energy recover capacitor Cr for a predetermined time Tr.

At this time, the time Tr where the initialization switch operates is scores of nano seconds (ns) within the T2 interval, which is enough margin for controlling the energy amount charged in the energy recovery capacitor Cr.

The operating time Tr of the initialization switch Sr is determined in consideration of a data change amount.

As so far described, according to the PDP energy recovery circuit and its recovery method of the present invention, the data is supplied to the address electrode by using the first and the second resonance points of the resonance wave form without delay after the PDP is charged, so that the addressing can be performed at a high speed. That is, by reducing the sustain voltage down (Sus_down) switching operation for recovering energy of the energy recovery capacitor, the addressing time can be shortened as much as the time allocated for the sustain voltage down operation, and thus, high speed addressing operation can be implemented.

In addition, since the PDP energy recovery circuit unit is implemented by using the less number of switches to ground the capacitors, the address driving unit is simply implemented.

Moreover, since the amount of the energy charged in the energy recovery capacitor is automatically controlled adaptively to the data change, an energy consumption due to an unnecessary switching operation can be reduced and the operation range of the PDP energy recovery apparatus can be controlled as well.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

I claim:

1. A plasma display apparatus comprising a plasma display panel, and a driving unit for generating a driving signal to drive the plasma display panel, the driving unit comprising:

a capacitor to recover a voltage from a plurality of address electrodes of the plasma display panel and to provide the recovered voltage back to the plasma display panel, wherein the recovered voltage charged in the capacitor from the plurality of address electrodes varies based on data to be displayed on the plasma display panel, wherein an inductor and an address driving unit are connected with the capacitor, and the inductor and the address driving unit are connected to each other by one power source.

2. The plasma display apparatus of claim 1, wherein the one power source has a voltage greater than a ground voltage.

3. The plasma display apparatus of claim 1, wherein the one power source supplies drive power Vd to each of the plurality of address electrodes of the plasma display panel.

4. The plasma display apparatus of claim 3, wherein the recovered voltage charged in the capacitor is between Vd/2 and Vd.

5. The plasma display apparatus of claim 4, wherein the recovered voltage between Vd/2 and Vd is based on a number of cells to be switched according to a variation of an image pattern to be displayed.

6. The plasma display apparatus of claim 1, wherein the inductor forms a resonance circuit together with capacitance loads at discharge cells of the plasma display panel.

7. The plasma display apparatus of claim 1, further comprising a first switching device between the inductor and the capacitor to control charging and discharging of the capacitor.

8. The plasma display apparatus of claim 7, further comprising a second switching device between the inductor and the one power source.

9. The plasma display apparatus of claim 1, wherein the address driving unit comprises:

a plurality of first switches for independently controlling each of the plurality of address electrodes; and a plurality of second switches each coupled between an end of a corresponding one of the plurality of first switches and a ground.

10. The plasma display apparatus of claim 9, wherein a first end of each of the plurality of first switches are commonly connected and a second end of each of the plurality of first switches is separately coupled to a different one of the plurality of address electrodes.

11. The plasma display apparatus of claim 9, wherein a first end of each of the plurality of second switches is coupled to the ground and a second end of each of the plurality of second switches is separately coupled to a different one of the plurality of address electrodes.

12. The plasma display apparatus of claim 1, wherein the recovered voltage in the capacitor is adaptive to a number of cells to be switched according to image data to be displayed.

13. The plasma display apparatus of claim 1, wherein the capacitor recovers an amount of voltage based on a variation of an image pattern to be displayed.

14. A plasma display apparatus comprising:

a plasma display panel, and a driving unit for generating a driving signal to drive the plasma display panel, the driving unit comprising:

an address driving unit coupled to a plurality of address electrodes; and an energy recovery circuit unit to recover a voltage from the address electrodes of the plasma display panel and to provide the recovered voltage back to the plasma display panel, the energy recovery circuit unit including an inductor and a capacitor to store the recovered voltage, wherein the recovered voltage charged in the capacitor from the address electrodes varies based on data to be displayed on the plasma display panel, wherein the inductor couples to the capacitor and the inductor couples to the address driving unit, and the inductor and the address driving unit are each coupled to an address voltage source.

15. The plasma display apparatus of claim 14, wherein the address voltage source has a voltage greater than a ground voltage.

16. The plasma display apparatus of claim 14, wherein the address voltage source to supply drive power Vd to each of the plurality of address electrodes of the plasma display panel.

17. The plasma display apparatus of claim 16, wherein the recovered voltage charged in the capacitor is between Vd/2 and Vd.

18. The plasma display apparatus of claim 17, wherein the recovered voltage between Vd/2 and Vd is based on a number of cells to be switched according to a variation of an image pattern to be displayed.

19. The plasma display apparatus of claim 14, further comprising a first switching device between the inductor and the capacitor to control charging and discharging of the capacitor.

20. The plasma display apparatus of claim 19, further comprising a second switching device between the inductor and the address voltage source.

21. The plasma display apparatus of claim 14, wherein the address driving unit comprises:

a plurality of first switches for independently controlling each of the plurality of address electrodes; and a plurality of second switches each coupled between an end of a corresponding one of the plurality of first switches and a ground.

22. The plasma display apparatus of claim 21, wherein a first end of each of the plurality of first switches are commonly connected and a second end of each of the plurality of first switches is separately coupled to a different one of the plurality of address electrodes.

23. The plasma display apparatus of claim 22, wherein a first end of each of the plurality of second switches are coupled to the ground and a second end of each of the plurality of second switches is separately coupled to a different one of the plurality of address electrodes.

* * * * *